US011692473B2

(12) United States Patent
Vierkant et al.

(10) Patent No.: US 11,692,473 B2
(45) Date of Patent: Jul. 4, 2023

(54) APPARATUS FOR CONTROLLING COOLING AIRFLOW TO AN INTERNAL COMBUSTION ENGINE, AND ENGINES AND METHODS UTILIZING THE SAME

(71) Applicant: Kohler Co., Kohler, WI (US)

(72) Inventors: Erich Vierkant, Kohler, WI (US); William D. Koenigs, Fond du Lac, WI (US); Brian Philipps, West Bend, WI (US); Michael J. Tursky, Fond du Lac, WI (US)

(73) Assignee: KOHLER CO.

( * ) Notice: Subject to any disclaimer, the term of this patent is extended or adjusted under 35 U.S.C. 154(b) by 0 days.

(21) Appl. No.: 17/974,160

(22) Filed: Oct. 26, 2022

(65) Prior Publication Data

US 2023/0040405 A1 Feb. 9, 2023

Related U.S. Application Data

(63) Continuation of application No. 16/031,327, filed on Jul. 10, 2018, now Pat. No. 11,512,623.

(60) Provisional application No. 62/533,264, filed on Jul. 17, 2017.

(51) Int. Cl.
*F01P 7/02* (2006.01)
*F01P 1/02* (2006.01)

(52) U.S. Cl.
CPC ..... *F01P 7/02* (2013.01); *F01P 1/02* (2013.01); *F01P 7/026* (2013.01); *F01P 2023/08* (2013.01); *F01P 2025/31* (2013.01)

(58) Field of Classification Search
CPC ..... F01P 7/02; F01P 7/026; F01P 1/02; F01P 2025/31; F01P 2023/08
See application file for complete search history.

(56) References Cited

U.S. PATENT DOCUMENTS

| | | | | |
|---|---|---|---|---|
| 1,367,031 A | | 2/1921 | Fedders | |
| 1,368,673 A | | 2/1921 | Willis | |
| 1,399,435 A | | 12/1921 | Lapsley | |
| 1,422,306 A | * | 7/1922 | Runnels | F01P 7/10 454/146 |

(Continued)

OTHER PUBLICATIONS

US 9,567,929 B2, 02/2017, Sugimoto (withdrawn)

*Primary Examiner* — Kurt Philip Liethen
(74) *Attorney, Agent, or Firm* — The Belles Group, P.C.

(57) ABSTRACT

An engine apparatus is provided that includes an internal combustion engine and a cooling airflow control subsystem The cooling airflow control subsystem includes an airflow regulator having a first component comprising one or more passageways extending through the first component, and a second component comprising one or more passageways extending through the second component, the second component mounted adjacent the first component; and an actuator operably coupled to the airflow regulator to cause relative rotation between the first and second components when actuated so that the airflow regulator can be altered between: (1) a first state in which the first and second passageways are aligned a first extent to allow a first amount of cooling airflow to reach the engine; and (2) a second state in which the first and second passageways are aligned a second extent to allow a second amount of cooling airflow to reach the engine, the first amount being greater than the second amount.

20 Claims, 18 Drawing Sheets

(56) References Cited

U.S. PATENT DOCUMENTS 1,503,366 A 7/1924 Jaray
1,695,446 A 12/1928 Weston
1,712,519 A 5/1929 Pipenhagen
1,806,153 A 5/1931 Edwards
1,817,398 A 8/1931 See
1,846,191 A 2/1932 Edwards
1,914,863 A 6/1933 Paetznick
1,935,118 A 11/1933 Giesler
1,973,078 A 9/1934 Jackson et al.
2,200,733 A 5/1940 Agerell et al.
2,207,147 A 7/1940 Gilbertson
2,219,051 A * 10/1940 Norby ..... F01P 7/10 49/73.1
2,276,279 A 3/1942 Asklund
2,314,476 A 3/1943 Blumenthal
2,429,208 A 10/1947 Matthews et al.
2,584,982 A 2/1952 Burke
2,638,881 A * 5/1953 Pankuch ..... F01P 7/10 236/35.2
2,654,354 A * 10/1953 Sanders ..... G05D 23/023 123/41.58
3,179,197 A 4/1965 Péras
3,759,054 A 9/1973 Graber
3,759,056 A 9/1973 Graber
4,475,485 A * 10/1984 Sakakibara ..... F01P 7/167 123/41.1
4,476,820 A 10/1984 Nixon
4,489,680 A 12/1984 Spokas et al.
4,539,943 A 9/1985 Tsuchikawa et al.
4,539,944 A 9/1985 Garcea et al.
4,619,073 A 10/1986 Janthur et al.
4,750,549 A 6/1988 Ziegler et al.
4,974,693 A 12/1990 Nakai et al.
5,036,803 A 8/1991 Nolting et al.
5,267,624 A 12/1993 Christensen
5,732,666 A 3/1998 Lee
6,189,608 B1 2/2001 Bodas
6,390,217 B1 5/2002 O'Brien et al.
6,467,538 B1 10/2002 Acre et al.
6,854,544 B2 2/2005 Vide
6,938,508 B1 9/2005 Saagge
7,182,047 B1 2/2007 Schwartz
7,766,111 B2 8/2010 Guilfoyle et al.
7,814,966 B2 10/2010 Prior
8,091,668 B2 1/2012 Amano et al.
8,181,727 B2 5/2012 Ritz et al.
8,267,054 B2 9/2012 McMillan
8,281,754 B2 10/2012 Saida et al.
8,292,014 B2 10/2012 Sugiyama
8,311,708 B2 11/2012 Kerns
8,439,276 B2 5/2013 Prior
8,463,493 B2 6/2013 Lockwood et al.
8,469,128 B2 6/2013 Van Buren et al.
8,473,164 B2 6/2013 Charnesky et al.
8,479,853 B2 7/2013 Verbrugge
8,505,660 B2 8/2013 Fenchak et al.
8,561,738 B2 10/2013 Charnesky et al.
8,561,739 B2 10/2013 Hori
8,627,911 B2 1/2014 Tregnago et al.
8,631,889 B2 1/2014 Begleiter
8,646,552 B2 2/2014 Evans et al.
8,655,545 B2 2/2014 Yu et al.
8,662,569 B2 3/2014 Klop
8,667,931 B2 3/2014 Kerns
8,689,917 B2 4/2014 Miesterfeld
8,708,077 B2 4/2014 Hori
8,714,290 B2 5/2014 Kitashiba et al.
8,720,624 B2 5/2014 Remy
8,731,783 B2 5/2014 Hayakawa et al.
8,733,484 B1 5/2014 Klop
8,739,744 B2 6/2014 Charnesky et al.
8,794,360 B2 8/2014 Nemoto
8,807,630 B2 8/2014 Rode et al.
8,825,308 B2 9/2014 Nishimura et al.
8,833,313 B2 9/2014 Lockwood et al.
8,833,498 B2 9/2014 Charnesky et al.
8,892,314 B2 11/2014 Charnesky et al.
8,893,836 B2 11/2014 Asano et al.
8,903,599 B2 12/2014 Sato et al.
8,915,320 B2 12/2014 Chinta
8,919,470 B2 12/2014 Hori
8,936,121 B2 1/2015 Vacca et al.
8,960,343 B2 2/2015 Asano et al.
8,967,308 B2 3/2015 Saito et al.
8,983,736 B2 3/2015 Hirota et al.
9,031,748 B2 5/2015 Sakai
9,162,562 B2 10/2015 Bourqui et al.
9,168,828 B2 10/2015 Bourqui
9,174,527 B2 11/2015 Hayakawa
9,174,629 B2 11/2015 Asami et al.
9,254,742 B2 2/2016 Chappex
9,303,549 B2 4/2016 Chellan et al.
9,365,106 B2 6/2016 Bruckner
9,376,010 B2 6/2016 Nam et al.
9,394,858 B2 7/2016 Richards et al.
9,409,474 B2 8/2016 Macfarlane et al.
9,447,719 B2 9/2016 Kiener et al.
9,523,305 B2 12/2016 Nam et al.
9,533,565 B2 1/2017 Elliott et al.
9,580,071 B2 2/2017 Asami et al.
9,604,533 B2 3/2017 Itoh
9,604,534 B1 3/2017 Zhou et al.
9,610,835 B2 4/2017 Nam et al.
9,650,942 B2 5/2017 Surnilla et al.
9,664,104 B2 5/2017 Glugla et al.
9,670,824 B2 6/2017 Sowards et al.
10,100,708 B2 * 10/2018 Lee ..... B60K 11/08
10,519,847 B2 * 12/2019 Elia ..... F02B 63/048
2006/0211364 A1 9/2006 Brotz et al.
2008/0257286 A1 10/2008 Harich et al.
2010/0147611 A1 6/2010 Amano et al.
2010/0243351 A1 9/2010 Sakai
2010/0243352 A1 9/2010 Watanabe et al.
2011/0232981 A1 9/2011 Hori et al.
2012/0074730 A1 3/2012 Bernt et al.
2012/0097464 A1 4/2012 Waugh et al.
2012/0270490 A1 10/2012 Turner et al.
2013/0081888 A1 4/2013 Charnesky et al.
2013/0095740 A1 4/2013 Hori
2013/0103265 A1 4/2013 Remy et al.
2013/0223980 A1 8/2013 Pastrick et al.
2013/0247862 A1 9/2013 Sakai et al.
2013/0252531 A1 9/2013 Asano et al.
2013/0252538 A1 9/2013 Huber et al.
2013/0268164 A1 10/2013 Sugiyama
2014/0039765 A1 2/2014 Charnesky et al.
2014/0090610 A1 4/2014 Higuchi et al.
2014/0273806 A1 9/2014 Frayer, III et al.
2014/0288760 A1 9/2014 Asano et al.
2015/0020758 A1 1/2015 Hosono et al.
2015/0147949 A1 5/2015 Macfarlane et al.
2015/0191078 A1 7/2015 Miyaji
2015/0343894 A1 12/2015 Yoshioka
2015/0369147 A1 12/2015 Itoh
2016/0186644 A1 6/2016 Murata
2016/0194999 A1 7/2016 Hakeem et al.
2016/0237884 A1 8/2016 Yamada et al.
2016/0311313 A1 10/2016 Hori
2016/0347303 A1 12/2016 Mura et al.
2016/0368366 A1 12/2016 Miller et al.
2017/0050509 A1 2/2017 Aizawa et al.
2017/0067388 A1 3/2017 Murata et al.
2017/0106741 A1 4/2017 Shaw et al.
2017/0113539 A1 4/2017 Prior et al.
2017/0120743 A1 5/2017 Dudar
2017/0129324 A1 5/2017 Kaneko et al.
2017/0159544 A1 * 6/2017 Nakaji ..... F01P 5/06
2017/0321593 A1 11/2017 Wolff et al.
2018/0149072 A1 5/2018 Lee et al.
2019/0017430 A1 1/2019 Vierkant et al.

* cited by examiner

APPARATUS FOR CONTROLLING COOLING AIRFLOW TO AN INTERNAL COMBUSTION ENGINE, AND ENGINES AND METHODS UTILIZING THE SAME

CROSS-REFERENCE TO RELATED APPLICATIONS

The present application is a continuation of U.S. patent application Ser. No. 16/031,327, filed Jul. 10, 2018, which claims the benefit of U.S. Provisional Application No. 62/533,264 filed Jul. 17, 2017, the entirety of which is incorporated herein by reference.

FIELD

The present invention relates generally to apparatus, systems and methods for adjusting cooling airflow to an internal combustion engine, and specifically to apparatus, systems and methods that adjust the amount of cooling airflow provided to an air-cooled internal combustion engine to maintain the operating temperature of the air-cooled engine at a sufficiently elevated temperature.

BACKGROUND

Many small internal combustion engines, such as those used in golf carts and other machines, are subject to repetitive switching between a running condition and a shutdown condition in short periods of time. One problem that can occur in such internal combustion engines is the issue of oil dilution wherein fuel gets into the oil sump by blowing past the piston rings in the vapor state. All engines have some degree of blowby. As the hot fuel vapor gets into the cool oil sump, the fuel vapor condenses and dilutes the oil.

In view of the above, a need exists for improved system, method, and engine apparatus that minimizes and/or eliminates oil dilution.

SUMMARY

The present invention relates to an engine apparatus that includes a cooling airflow control system that is configured to minimize and/or eliminate oil dilution.

The engine apparatus may comprise an internal combustion engine and a cooling airflow control subsystem. The cooling airflow control subsystem may comprise an airflow regulator having a first component comprising one or more passageways extending through the first component, and a second component comprising one or more passageways extending through the second component, the second component mounted adjacent the first component; and an actuator operably coupled to the airflow regulator to cause relative rotation between the first and second components when actuated so that the airflow regulator can be altered between: (1) a first state in which the first and second passageways are aligned a first extent to allow a first amount of cooling airflow to reach the engine; and (2) a second state in which the first and second passageways are aligned a second extent to allow a second amount of cooling airflow to reach the engine, the first amount being greater than the second amount.

The engine apparatus may comprise an internal combustion engine and a cooling airflow control subsystem. The cooling airflow control subsystem may comprise an airflow regulator; an actuator operably coupled to the airflow regulator so that the airflow regulator can be altered between: (1) a first-state in which a first amount of cooling airflow is allowed to reach the internal combustion engine; and (2) a second-state in which a second amount of cooling airflow is allowed to reach the internal combustion engine, the first amount being greater than the second amount, the first amount being greater than the second amount and the airflow regulator configured to be biased into the first state; and a locking assembly that locks the first and second components in a selected one of the first and second states.

The engine apparatus may comprise an internal combustion engine and a cooling airflow control subsystem. The cooling airflow control subsystem may comprise, in operable cooperation: a sensing element configured to detect a condition of the engine indicative of oil dilution; and an airflow regulator operably coupled to the sensing element, the airflow regulator alterable between: (1) a first-state in which a first amount of cooling airflow is allowed to reach the engine; and (2) a second-state in which a second amount of cooling airflow is allowed to reach the engine, the first amount being greater than the second amount. Upon the sensing element detecting the condition, the airflow regulator is altered from the first-state to the second-state.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE DRAWINGS

Figure 1:
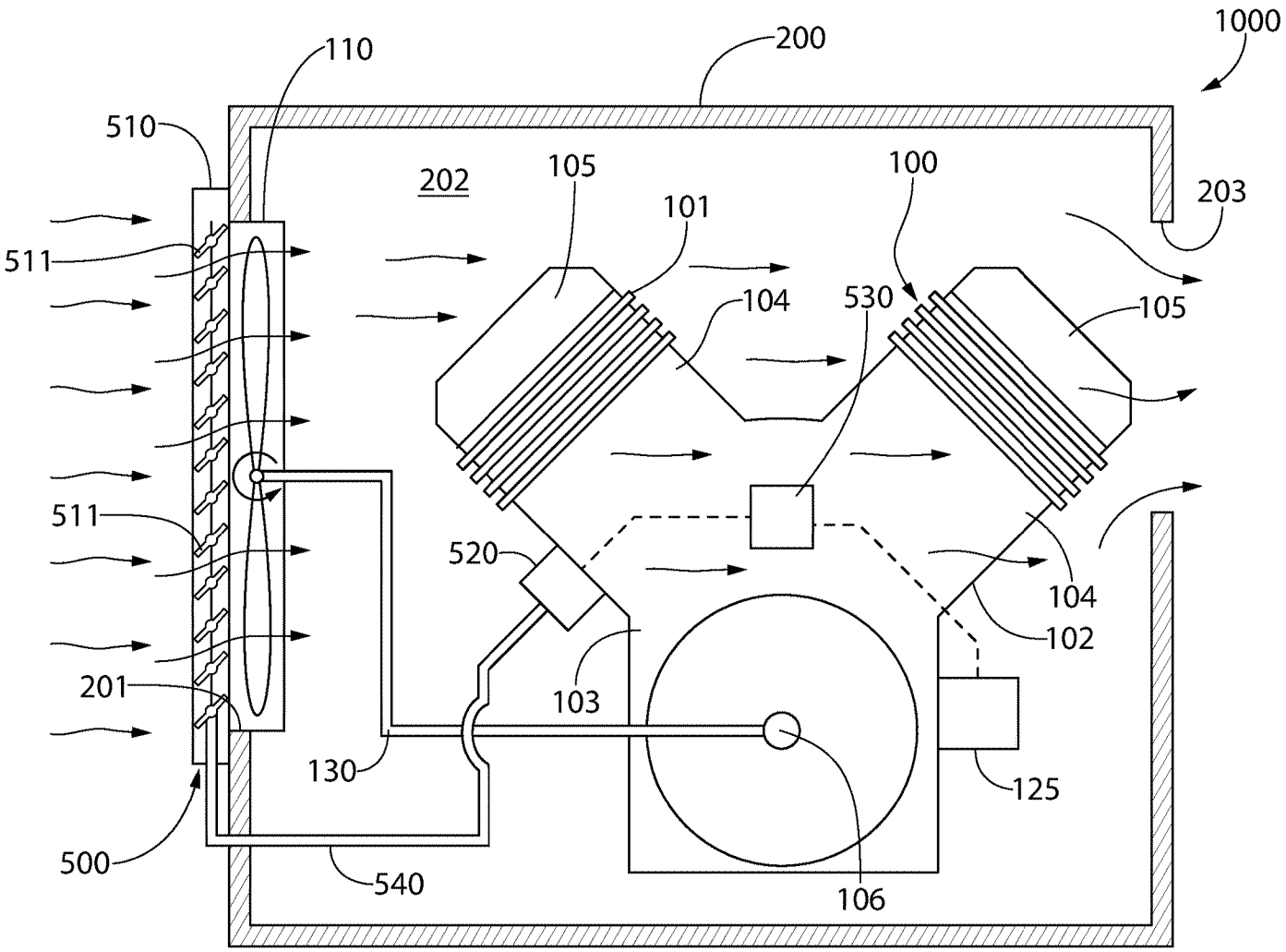
FIG. 1 is a schematic of an engine apparatus having a cooling airflow control subsystem incorporated therein in accordance with the present invention, wherein the cooling airflow control subsystem is in an open-state.

The following description of embodiment(s) of the invention is merely exemplary in nature and is in no way intended to limit the invention, its application, or uses. The description of illustrative embodiments according to principles of the present invention is intended to be read in connection with the accompanying drawings, which are to be considered part of the entire written description. In the description of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the examples illustrated herein. Accordingly, the invention expressly should not be limited to such examples, even if indicated as being preferred. The discussion herein describes and illustrates some possible non-limiting combinations of features that may exist alone or in other combinations of features.

Referring first to FIG. 1, an engine apparatus 1000 according to the present invention is schematically illustrated. The engine apparatus 1000 generally comprises an engine 100, a cooling airflow control subsystem 500, and a housing 200. As exemplified, the engine 100 is an air-cooled engine in which the cooling fins 101 are integrated into the engine block 102. In other arrangements, the engine 100 may, however, be a liquid-cooled engine that utilizes a separate heat exchanger to remove heat from the circulated engine coolant. In such arrangements, the cooling airflow control subsystem 500 may be configured to control the amount of cooling airflow that flows over and/or through the separate heat exchanger, as opposed to the cooling fins 101 that are integrated into to the engine block 102. The engine block 102, as used herein, broadly includes the crankcase 103, the cylinder blocks 104, and the cylinder heads 105. While not illustrated, the engine 100, of course, comprises and is supplemented by many other sub-systems and elements/components. Such details are omitted herein for ease of discussion with the understanding that such details are not necessary for the understanding of the present invention.

The engine 100 is located, at least partially, within the housing 200. The housing 200, in one arrangement, is a blower housing that is mounted to the engine block 102. In other arrangements, the housing 200 can be a protective shroud or other structure that partially or fully encloses the engine 100. In one such arrangement, the housing 100 may include various combinations of machine hoods, access panels, walls, quarter panels, bulk heads, or the like that collectively define an engine compartment.

The housing 200 comprises an air inlet 201 that forms a passageway into the internal cavity 202 of the housing 200 in which the engine 100 is located. Cooling air enters the housing 200 via the air inlet 201 and flows over the engine 100 to remove heat. As will be discussed in greater detail below, the amount of cooling airflow that is allowed to flow through the air inlet 201 (and thus across the engine 100) is controlled by the cooling airflow control subsystem 500. As such, the cooling airflow control subsystem 500 can be used to manipulate (increase, decrease, or hold steady) the operating temperature of the engine 100 by adjusting the amount of cooling airflow that is allowed to reach the engine 100. As the cooling airflow flows over the engine 100, it becomes heated and exits the housing 200 via the air outlet 203. The air outlet 203 may be a well-defined passageway (or plurality of passageways) or may simply be a terminus of the housing 200 through which part of the engine 100 protrudes. Moreover, while the air inlet 201 is exemplified as a single opening, it may also comprise a plurality of openings and/or passageways.

In the exemplified arrangement, the engine 100 comprises an airflow generator 110, which is in the form of a fan. The airflow generator 110 is operably coupled to the drive shaft 106 of the engine 100 (which is schematically represented by the generic linkage 130 in the drawing). Rotation of the drive shaft 106 rotates the air flow generator 110, which in turn produces (or increases) cooling airflow that is drawn (or forced) into the air inlet 102, over the engine 100, and out of the housing 200 via the air outlet 203. The airflow generator 110, in the exemplified, arrangement, is aligned with the air inlet 201. The airflow generator 110 may be directly coupled to the drive shaft 106 by being mounted thereto or can be indirectly coupled thereto through pulleys, belts, and/or other linkages.

It should be noted, however, that in other arrangements of the invention, the airflow generator 110 may be omitted. For example, in one such embodiment, cooling airflow through the housing 200 (and over the engine 100) may be facilitated by simply providing the air inlet 210 at a position on the machine such that relative airflow that is induced through movement of the machine passes into the housing 200.

The airflow control subsystem 500, as exemplified, generally comprises an adjustable airflow regulator 510, an actuator 520, and a temperature sensing element 530. The actuator 520 is operably coupled to each of the temperature sensing element 530 and the adjustable airflow regulator 510. In the exemplified embodiment, the actuator 520 is operably coupled to the adjustable airflow regulator 510 via a mechanical linkage 540 (which is generically illustrated). The mechanical linkage 540 can be any type or number of bars, rods, pulleys, belts, combinations thereof, or any other device and/or member capable of transferring physical movement. Moreover, in certain arrangements of the invention, the mechanical linkage 540 is omitted altogether and the actuator 520 can be directly coupled to the adjustable airflow regulator 510. In still other arrangements, the mechanical linkage 540 is integrated into the actuator 520 and/or the adjustable airflow regulator 510.

The actuator 520 in one arrangement is an electromagnetic actuator, such as an electromagnetic solenoid wrapped around a metal cylinder that is alterable between a retracted state and an extended state based on whether or not electricity is supplied to the electromagnetic solenoid. In other embodiments, the actuator 520 may be any device or assembly that can respond to the state of (or a signal generated by) the temperature sensing element 530 to physically manipulate the adjustable airflow regulator 510 between an open-state and closed-state (discussed in greater detail below). For example, in other arrangements, the actuator 520 may take the form of electric actuators, electromagnetic actuators, piezoelectric actuators, pneumatic actuators, hydraulic pistons, relays, comb drives, thermal bimorphs, digital micromirror devices and electroactive polymers.

The actuator 520 is operably coupled to the temperature sensing element 530 and responds thereto. The temperature sensing element 530 is operably coupled to the engine block 102 so as to be in thermal communication with the engine 100. The temperature sensing element 530 is capable of sensing the temperature of the engine 100. Thermal communication between the temperature sensing element 530 and the engine can be accomplished directly or indirectly. For example, the temperature sensing element 530 can be mounted directly to the engine block 102 so as to be in physical contact therewith. In other arrangements, the temperature sensing element 530 can be placed in contact with the oil in the sump of the crankcase 103, or in contact with other fluids and/or components whose temperature corresponds to the operating temperature of the engine 100, such as the on or in the cylinder heads. The selection and position of the temperature sensing element 530 is not limiting of the present invention so long as the temperature sensing element 530 is selected and positioned to respond in a desired manner based on the operating temperature of the engine 100.

The temperature sensing element 530, in one arrangement, is a thermal switch that is operably coupled to an alternator 125 of the engine. Depending on the operating temperature of the engine 100 (which is detected by the thermal switch), the thermal switch assumes either a closed-state or an open-state, thereby either allowing or cutting off electrical current that is generated by the alternator 125 from the actuator 520. As a result, the actuator 520 will be actuated, thereby either opening or closing (either partially or fully) the adjustable airflow regulator 510. It should be noted that the temperature sensing element 530 can take on a wide variety of devices and is not limited to thermal switches. Suitable devices include thermocouples, thermistors, resistance thermometers, silicon bandgap temperature sensors, thermostats, RTD's and/or state change temperature sensors.

The adjustable airflow regulator 510 is adjustable between an open-state and a close-state. As used herein, the term open-state and closed-state are broadly used as terms that are relative to one another and do not necessarily mean fully-open or fully-closed. Stated simply, when the adjustable airflow regulator 510 is described to be in an open-state, it simply means that the adjustable airflow regulator 510 allows an amount of cooling airflow to reach the engine 100 that is greater than the amount of cooling airflow that is allowed to reach the engine 100 when the adjustable airflow regulator 510 is in the closed-state.

The adjustable airflow regulator 510 can be any device, assembly, or structure that can be manipulated in a manner that results in more or less cooling airflow to be allowed to reach the engine 100 for cooling purposes. In the exemplified arrangement, the adjustable airflow regulator 510 comprises one or more louvres 511 which can be rotated to assume different angular positions that result in different percentages of the air inlet 201 being blocked (i.e., choked off). The louvres 511 may be linear elements, as shown in FIG. 1, or they can be radial louvres as will be described later in reference to FIGS. 3-10.

In still other arrangements, the adjustable airflow regulator 510 can be one or more sliding plates (or other doors or gates) whose position can be adjusted to block off different percentages of the air inlet 201. Further arrangements of the adjustable airflow regulator 510 include adjustable valves, orifice restrictors, pinch valves, and any other means of adjustably blocking airflow. The exact device, assembly, or structure of the adjustable airflow regulator 510 will be dictated not only by engine needs but also by the structure of the housing 200, the type of engine 100 with which it is being used, the structure of the cooling airflow passageway that leads to the engine 100, whether or not an airflow generator 110 is implemented, and other considerations.

Figure 2:
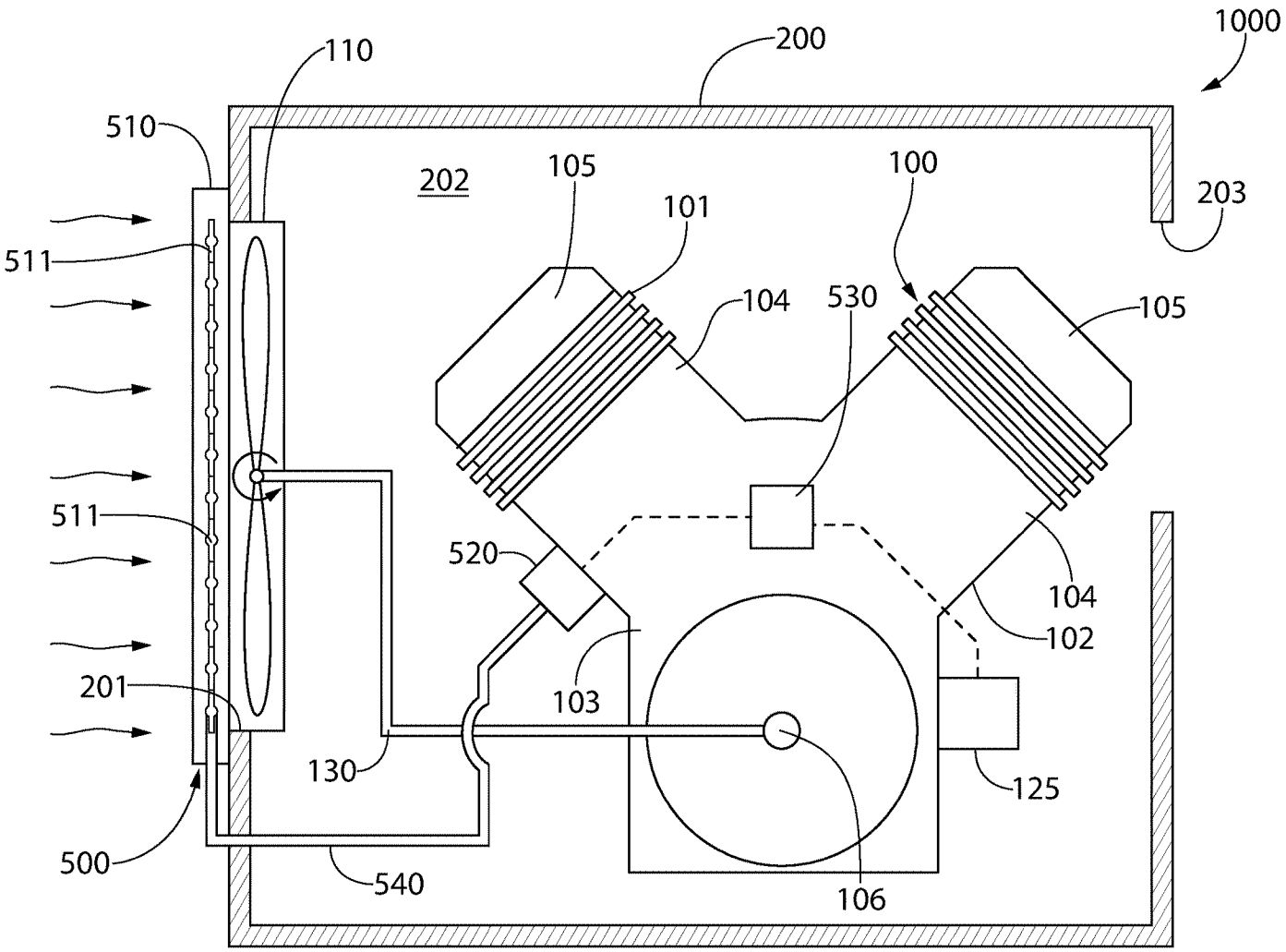
FIG. 2 is a schematic of the engine apparatus of FIG. 1, wherein the cooling airflow control subsystem is in a closed-state.

Referring now to FIGS. 1 and 2 concurrently, operation of the airflow control subsystem 500 to ensure that the engine 100 operates at a sufficiently elevated temperature that minimizes and/or eliminates oil dilution will be described. In FIG. 1, the airflow control subsystem 500 has detected, via the temperature sensing element 530, that the operating temperature of the engine 100 is sufficiently high so that the oil in the sump is at a sufficiently hot temperature such that any fuel present therein will be vaporized. Once vaporized, the fuel vapor can escape the oil (and eventually escape the engine 100), thereby minimizing, reducing and/or eliminating oil dilution. Thus, the adjustable airflow regulator 510 is an open-state and allow cooling airflow to freely enter the housing 200 and cool the engine 100. In FIG. 2, the airflow control subsystem 500 has detected, via the temperature sensing element 530, that the operating temperature of the engine 100 is too cool, thereby resulting in the oil in the sump being at a temperature that is too cool to vaporize fuel that may be present in the oil. As a result, the fuel remains in the oil in liquid form, resulting in continued oil dilution. Thus, the adjustable airflow regulator 510 is in a closed-state, thereby prohibiting cooling airflow from freely entering the housing 200 to cool the engine 100. As a result of prohibiting the cooling airflow from reaching the engine 100, heat is not removed from the engine 100 and the operating temperature of the engine 100 increases. Increased operating temperature of the engine 100 results in an increase in the oil temperature that results in the fuel within the oil becoming vaporized. The airflow control subsystem 500 maintains the adjustable airflow regulator 510 in the closed-state until the temperature sensing element 530 detects that the operating temperature of the engine 100 has reached a sufficiently high temperature to ensure adequate vaporization of any fuel that may be within the oil to minimize, remedy, and/or prevent oil dilution. Once a sufficiently high temperature is detected, the airflow control subsystem 500 alters the adjustable airflow regulator 510 back to the open-state to prevent unsafe and/or undesirably excessive engine temperature.

In one arrangement, the airflow control subsystem 500 is designed so that the adjustable airflow regulator 510 is in a normally open-state. For example, the adjustable airflow regulator 510 may be biased into the open-state by a resilient element and, absent the airflow control subsystem 500 undertaking a positive (and continued) action that overcomes the biasing force of the resilient element, the adjustable airflow regulator 510 will remain in (or return to) the open-state. The biasing force can be applied to the adjustable airflow regulator 510, to the actuator 520, and/or to the linkage 540. In the open-state, cooling airflow is allowed to freely pass through the adjustable airflow regulator 510, through the air inlet 201, and over the engine 100, thereby removing heat from the engine 100. Designing the airflow control subsystem 500 so that the adjustable airflow regulator 510 is in a normally open-state prevents overheating of the engine in the event of a system malfunction.

When the engine 100 is first started, the airflow control subsystem 500 starts at the position shown in FIG. 1 due to the adjustable airflow regulator 510 being biased into the normally open-state. At this time, the temperature sensing element 530 also senses the temperature of the engine 100. Assuming that the engine 100 is cold, the temperature sensing element 530 detects that the engine 100 is at or below a lower-threshold engine operating temperature (discussed below). As a result, the temperature sensing element 530 transmits a signal to the actuator 520 that results in the actuator 520 adjusting the adjustable airflow regulator 510 from the open state (FIG. 1) to the closed-state (FIG. 2).

In the exemplified arrangement, the signal sent by the temperature sensing element 530 to the actuator is an electrical current generated by the alternator 125. More specifically, when the engine temperature is sensed to be at or below the lower-threshold temperature, the temperature sensing element 530 passes the electrical current generated by the alternator 125 onto the actuator 520. Upon being powered, the actuator 520 operates, thereby overcoming the force of the one or more resilient elements that biases the adjustable airflow regulator 510 into the open-state. As result, the adjustable airflow regulator 510 assumes the closed-state and prohibits (which includes reducing or eliminating) cooling airflow from reaching the engine 100. Thus, with continued operation, the temperature of the engine 100 will begin to rise.

During this state, the temperature sensing element 530 continues to sense the temperature of the engine 100. The adjustable airflow regulator 510 will remain in the closed-state until the temperature sensing element 530 senses that the temperature of the engine 100 is at or above an upper-threshold temperature. Upon the temperature sensing element 530 sensing that the temperature of the engine 100 is at or above the upper-threshold temperature, the temperature sensing element 530 transmits a signal (or ceases sending a signal) to the actuator 520 that results in the actuator 520 adjusting the adjustable airflow regulator 510 from the closed-state (FIG. 2) to the open-state (FIG. 1).

As discussed above, in the exemplified arrangement, the signal being sent by the temperature sensing element 530 to activate the actuator 520 is the supply of electrical current generated by the alternator 125. Thus, in this arrangement, when the engine temperature is sensed to be at or above the upper-threshold temperature, the temperature sensing element 530 cuts off the electrical current from the alternator 125 from reaching the actuator 520. Upon being cut off from the electrical current supply, the actuator 520 shuts down and the force of the one or more resilient elements returns the adjustable airflow regulator 510 into the open-state. As result, the cooling airflow is allowed to reach the engine 100. In this embodiment, shutdown of the engine 100 will also automatically return the adjustable airflow regulator 510 into the open-state.

In one arrangement, the upper-threshold temperature and/or the lower-threshold temperature may be selected so that the engine 100 will operate at a temperature (or within a temperature range) that reduces, minimizes and/or eliminates oil dilution by ensuring that the oil is at a sufficiently high temperature such that the fuel trapped therein will vaporize. The upper-and lower-threshold temperatures can be set through data analysis, graphs, charts, and/or experimental techniques, as would be understood by those of skill in the art. The exact empirical values of the upper- and lower-threshold temperatures are not limiting of the present invention and will depend on such factors such as the type of engine, the type of fuel being burned, the air-fuel mixture ratio, where the temperature is being measured (e.g., direct oil measurement or engine block). In one example, however, the lower-threshold temperature will be in a preferred range of 90° F. to 150° F., a more preferred range of 100° F. to 125° F., and about 100° F. being most preferred. The upper-threshold temperature may be in a preferred range of 275° F. to 375° F., a more preferred range of 300° F. to 350° F., and about 336° F. being most preferred.

In one arrangement, the upper-threshold temperature is greater than the lower-threshold temperature. In a further arrangement, however, the upper-threshold temperature may be the same as the lower-threshold temperature, thereby effectively reducing the system to a single temperature dependency.

Furthermore, while the adjustable airflow regulator 510 is described as having two states, namely an open-state and a closed-state, it is to be understood that the adjustable airflow regulator 510 can be configured to have a plurality of selectable positions between a fully open-state and a fully closed-state to which the adjustable airflow regulator 510 can be set by the actuator 520. In one arrangement, the actuator 520 and/or adjustable airflow regulator 510 can be configured so that the adjustable airflow regulator 510 can be infinitely adjustable. Such infinite or incremental adjustments can provide a more fine-tuned control of the temperature of the engine 100.

Finally, it should be noted that in an even further arrangement, the adjustable airflow regulator 510 may take the form of the airflow generator 110, which would be operably coupled to and controlled by the temperature sensing element 530. For example, if the temperature of the engine 100 was sensed to be at or below the lower-threshold temperature, the airflow generator 110 would be shutdown, thereby minimizing cooling airflow that reaches the engine 100. However, if the temperature of the engine 100 was sensed to be at or above the upper-threshold temperature, the airflow generator 110 would be activated, thereby restoring cooling airflow to the engine 100.

Turning now to FIGS. 3-10 concurrently, a structural arrangement of an engine apparatus 1000A according to the present invention is illustrated. The engine apparatus 1000A is a structural manifestation of the schematically illustrated engine apparatus 1000 discussed above with respect to FIGS. 1-2. Thus, like components will be referenced with like numerical identifiers, with the exception that the alphabetical suffix "A" will be added. Moreover, only certain aspects of the engine apparatus 1000A will be discussed below in order to avoid redundancy and with the understanding that the discussion set forth above for the engine apparatus 1000 is applicable to the engine apparatus 1000A.

Figure 3:
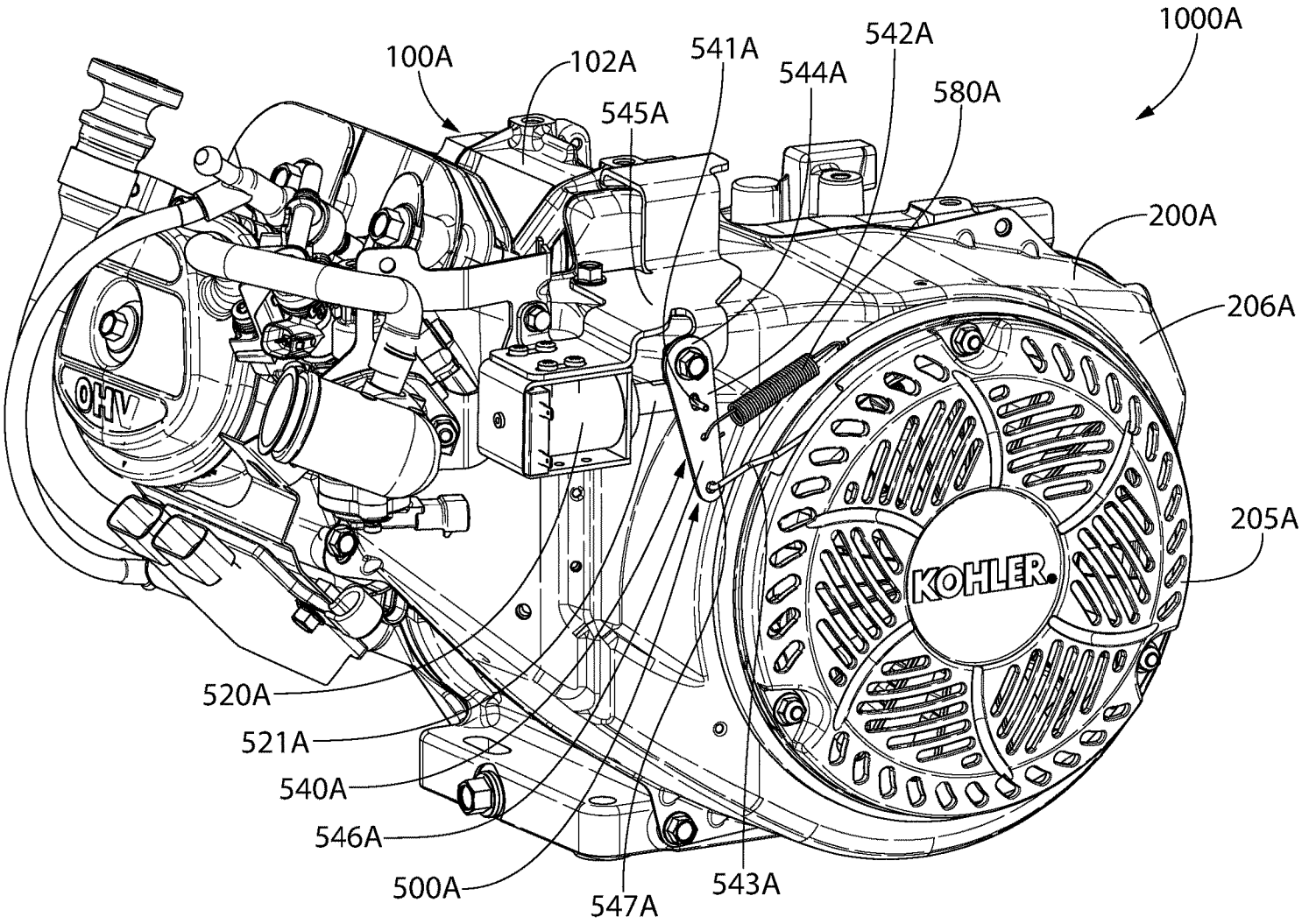
FIG. 3 is a front perspective view an air-cooled engine apparatus having a cooling airflow control subsystem incorporated therein in accordance with the present invention.
Figure 4:
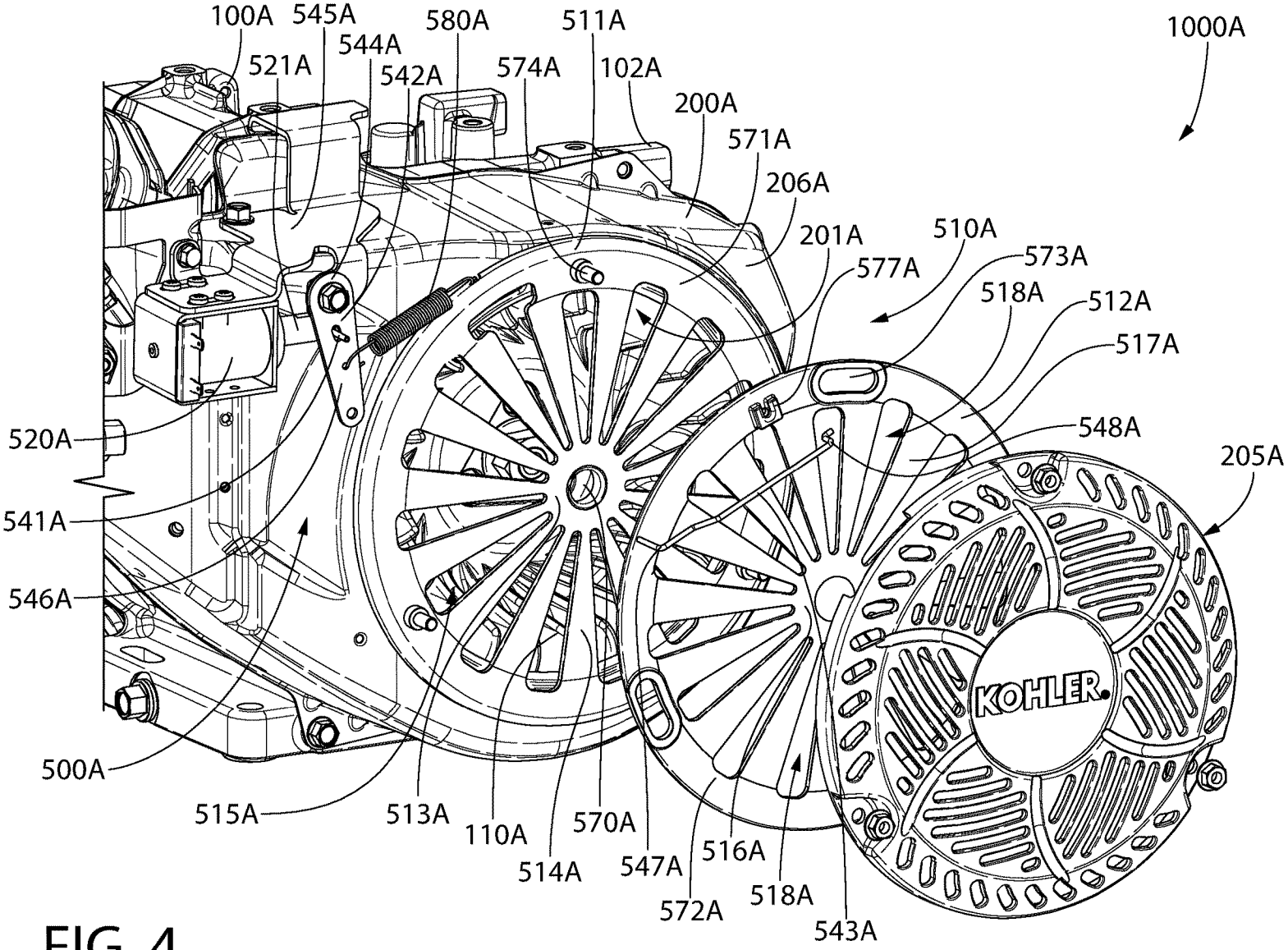
FIG. 4 is an exploded view of the air-cooled engine apparatus of FIG. 3.

Referring now to FIGS. 3-4 specifically, the engine apparatus 1000A generally comprises an engine 100A, a blower housing 200A, and an airflow control subsystem 500A. The blower housing 200A is mounted to the engine block 102A of the engine 100. An airflow generator 110A, in the form of a blower fan, is also provided and operably coupled to a drive shaft (not visible) of the engine 100A. The blower housing 200A comprises an air inlet 201A that provides a passageway into the blower housing 200A so that cooling air can be drawn therein via operation of the airflow generator 110A and introduced to the engine 100 for heat removal purposes. In the exemplified arrangement, the blower housing 200A comprises a protective blower cover 205A that is removably coupled to the blower housing body 206A. The protective blower cover 205A covers the air inlet 201A and comprises a plurality of apertures that allow cooling air to pass therethrough as needed.

The airflow control subsystem 500A generally comprises, in operable coupling, an actuator 520A, a temperature sensing element 530A (not visible), and an adjustable airflow regulator 510A. The adjustable airflow regulator 510A, in the exemplified embodiment, is a multi-component louvre assembly comprising a fixed radial louvre plate 511A and a rotatable louvre plate 512A. The fixed radial louvre plate 511A is fixedly mounted to the engine 100 so as to be non-rotatable relative to the engine block 102A. In other arrangements, the fixed radial louvre plate 511A may be mounted to the blower housing 200A. The rotatable louvre plate 512A, on the other hand, is pivotably mounted to the engine 100A so as to be rotatable (relative to the engine block 102A) about a rotational axis A-A (shown in FIGS. 5 and 6). In the exemplified arrangement, the rotatable louvre plate 512A is pivotably mounted to the engine 100A indirectly through coupling to the fixed radial louvre plate 511A (discussed in greater detail below). However, in other arrangements the rotatable louvre plate 512A may be pivotably mounted directly to the engine block 102A or the blower housing 200A. Moreover, while the radial louvre plate 511A is referred to as "fixed" and the radial louvre plate 512A is referred to as "rotatable," in other arrangements each of the radial louvre plates 511A, 512A can be allowed to rotate relative one another or their "fixed" and "rotatable" status may be transposed. Furthermore, in certain arrangements, the fixed radial louvre plate 511A may be integrally formed as part of the blower housing 200 or the engine 100, rather than as a separate component The fixed radial louvre plate 511A comprises a central hub portion 513A and plurality of radial louvres 514A extending radially outward from the central hub portion 513A. The terminal end of each of the radial louvres 514A of the fixed radial louvre plate 511A are connected to a perimetric outer frame portion 571A. The plurality of radial louvres 514A are separated from one another by a plurality of elongated radial slots 515A that form passageway through the fixed radial louvre plate 511A. Similarly, the rotatable radial louvre plate 512A comprises a central hub portion 516A and plurality of radial louvres 517A extending radially outward from the central hub portion 516A. The terminal end of each of the radial louvres 517A of the rotatable radial louvre plate 512A are connected to a perimetric outer frame portion 572A. The plurality of radial louvres 516A are separated from one another by a plurality of elongated radial slots 518A that form passageway through the rotatable radial louvre plate 512A.

Figure 7:
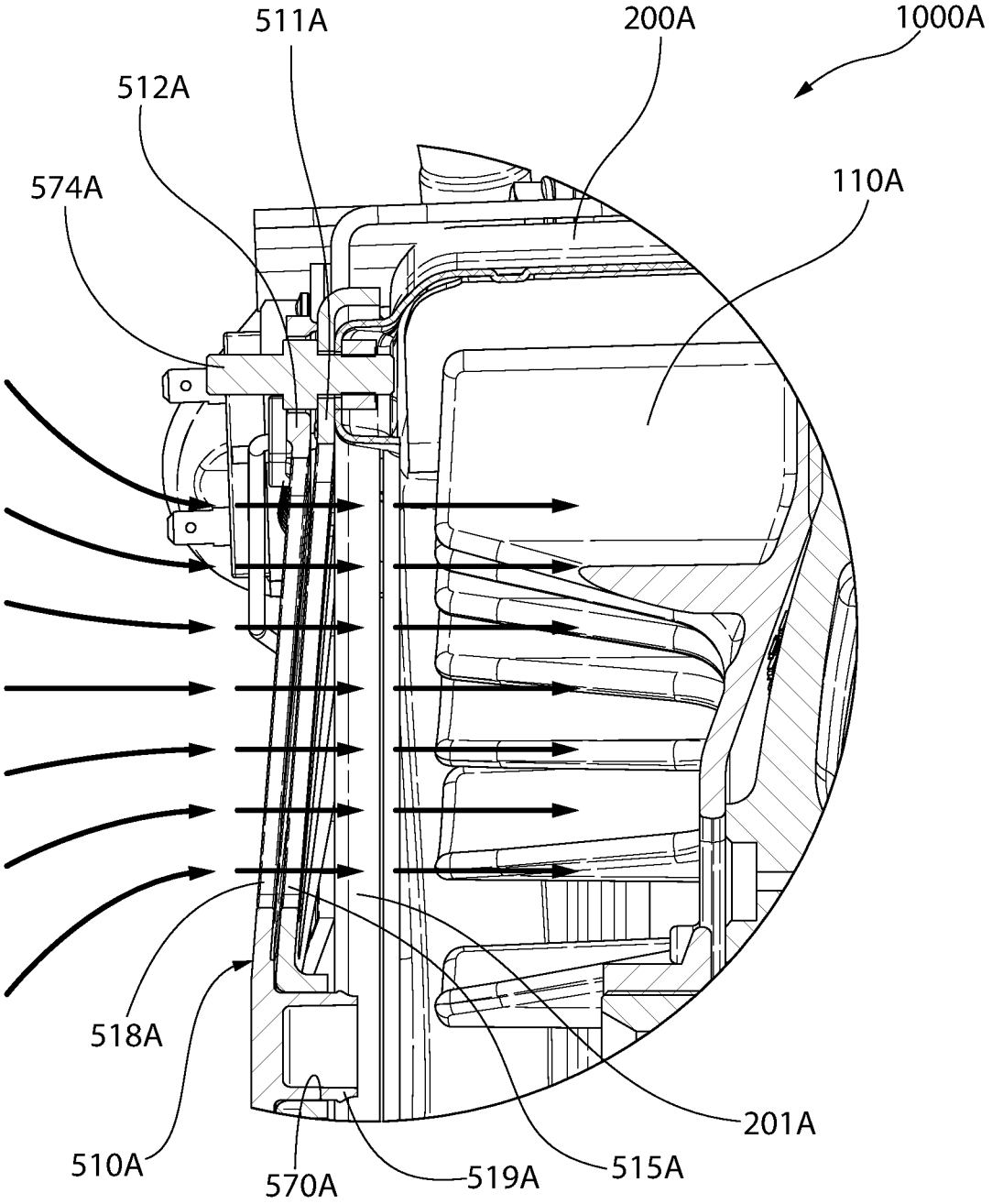
FIG. 7 is a cross-sectional view of the air-cooled engine apparatus taken along view VII-VII of FIG. 6.

As visible in FIG. 7, the rotatable radial louvre plate 512A is pivotably mounted to the fixed radial louvre plate 511A via a snap-fit plug 519A that protrudes from the rear surface of the central hub portion 516A of the rotatable radial louvre plate 512A and matingly engages a central opening 570A of the central hub portion 513A of the fixed radial louvre plate 511A. Each of the fixed and rotatable radial louvre plates 511A, 512A are concentrically positioned about the axis of rotation A-A.

Referring again to FIGS. 3-4, the rotatable radial louvre plate 512A further comprises a plurality of circumferential slots 573A in the perimetric outer frame portion 572A while the fixed radial louvre plate 511A comprises a plurality of corresponding pegs 574A protruding from the perimetric outer frame portion 571A. When assembled, the pegs 574A of the fixed radial louvre plate 511A extend into the circumferential slots 573A of the rotatable radial louvre plate 512A. As will become apparent from the discussion below, when the rotatable radial louvre plate 512A is pivoted relative to fixed radial louvre plate 511A, interaction/interference between the pegs 574A and the end walls 598A, 599A of the circumferential slots 573A delimit the relative angular movement allowed between the fixed radial louvre plate 511A and rotatable radial louvre plate 512A. Thus, this interaction/interference between the pegs 574A and the end walls 598A, 599A establish the fully open-state and the fully closed-state of the adjustable airflow regulator 510A. In other arrangements not shown herein, the pegs 574A may be located on the rotatable radial louvre plate 512A and the circumferential slots 573A may be located on the fixed radial louvre plate 511A. In still other arrangements, other structural interference and/or slidable mating structures may be utilized to delimit the relative angular movement allowed between the fixed radial louvre plate 511A and rotatable radial louvre plate 512A.

The adjustable airflow regulator 510A is operably coupled to the actuator 520A via a mechanical linkage 540A. In the exemplified arrangement, the actuator 520A is an electromagnetic actuator, and more specifically an electromagnetic solenoid wrapped around a metal cylinder that is alterable between a retracted state (shown in FIG. 8) and an extended state (shown in FIG. 6). As exemplified, the mechanical linkage 540A comprises an actuator rod 541A, a rocker arm 542A, and a connecting rod 543A. A first end 544A of the rocker arm 542A is pivotably coupled to a bracket 545A. The actuator 520A is also mounted to the bracket 545A.

The actuator rod 541A, which is coupled to and translates with the cylinder 521A of the actuator 520A, is coupled to the a middle portion of the rocker arm 542A. Thus, as the actuator 520A changes states between the cylinder 521A being extended or retracted, the rocker arm 542A pivots about its connection point at its first end 544A. As a result, the second end 546A of the rocker arm also travels back-and-forth through an angle of rotation. The second end 546A of the rocker arm 542A is connected to a first end 547A of the connecting rod 543A. A second end 548A of the connecting rod 543A is coupled to an engagement feature 577A of the rotatable radial louvre plate 512A. As will be described in greater detail below, as the rocker arm 542A is pivoted by the extension and retraction of the cylinder 521A of the actuator 520A, the connecting rod 543A transmits this motion into angular rotation of the rotatable radial louvre plate 512A about the rotational axis A-A.

A resilient element 580A, in the form of a spring, is also provided. The resilient element 580A is coupled to the rocker arm 542A at one end and to the fixed radial louvre plate 511A at its other end. The resilient element 580 biases the adjustable airflow regulator 510A into the fully-open state by acting on the rocker arm 542A so as to rotate the rotatable radial louvre plate 512A into an angular position in which the radial slots 518A of the rotatable radial louvre plate 512A are aligned with radial slots 515A of the fixed radial louvre plate 511A. This will be described in greater detail below.

Figure 5:
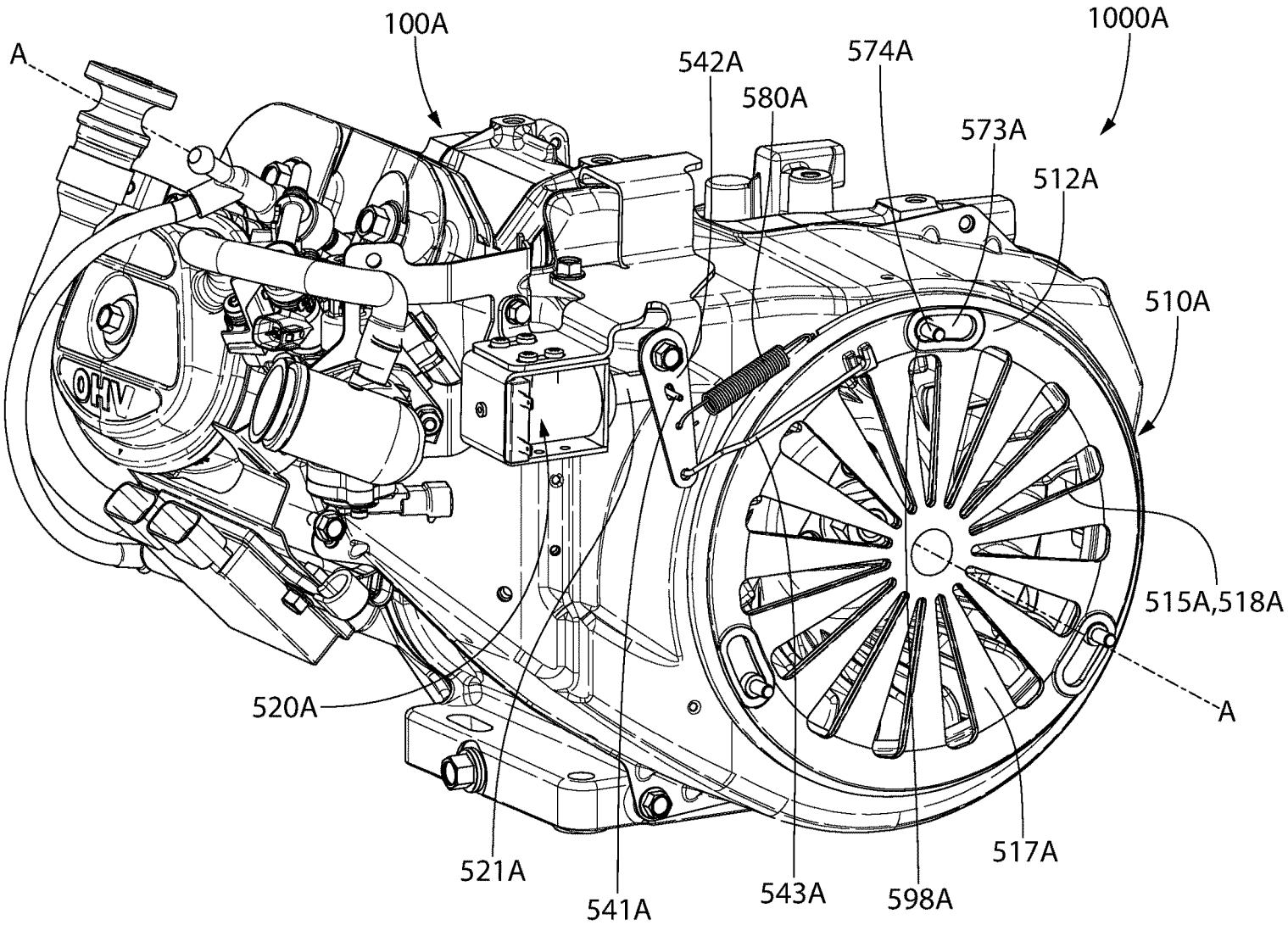
FIG. 5 is a front perspective view of the air-cooled engine apparatus of FIG. 3 wherein the protective blower cover has been removed and the cooling airflow control subsystem is in an open-state.
Figure 6:
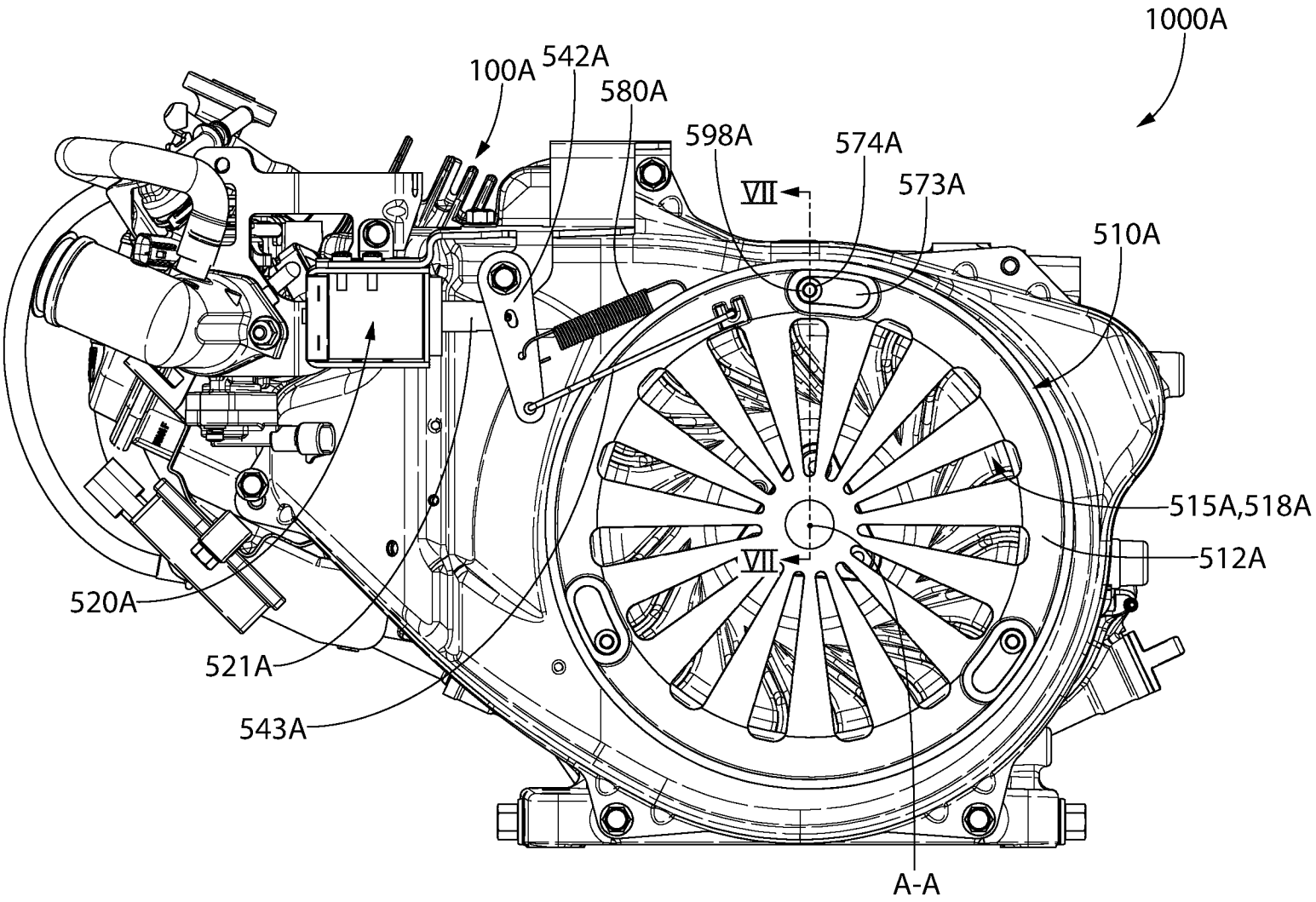
FIG. 6 is a front view of the air-cooled engine apparatus of FIG. 5.

Referring now to FIGS. 5-9, operation of the airflow control subsystem 500A to ensure that the engine 100A operates at a sufficiently elevated temperature to minimize and/or eliminate oil dilution will be described. In FIGS. 5-7, the airflow control subsystem 500A has detected, via the temperature sensing element 530A (which is in the form of a thermal spring that is not visible), that the operating temperature of the engine 100A is sufficiently high so that the oil in the sump is at a sufficiently hot temperature such that any fuel present therein will be vaporized (or maintained in a vaporized state). Once vaporized, the fuel vapor can escape the oil (and eventually escape the engine 100A), thereby minimizing, reducing and/or eliminating oil dilution. Thus, the adjustable airflow regulator 510A (which is formed by the fixed and rotatable radial louvre plates 511A, 512A) is in an open-state, thereby allowing cooling airflow to freely enter the blower housing 200A and cool the engine 100A. In FIGS. 7-10, the airflow control subsystem 500A has detected, via the temperature sensing element 530A, that the operating temperature of the engine 100A is too cool, thereby resulting in the oil in the sump being at a temperature that is too cool to vaporize fuel that may be present in the oil. As a result, the fuel remains in the oil in liquid form, resulting in continued oil dilution. Thus, the adjustable airflow regulator 510A (which is formed by the fixed and rotatable radial louvre plates 511A, 512A) is in a closed-state, thereby prohibiting cooling airflow from freely entering the blower housing 200A to cool the engine 100A. As a result of prohibiting the cooling airflow from reaching the engine 100A, heat is not removed from the engine 100A and the operating temperature of the engine 100A increases.

Referring specifically now to FIGS. 5-7 concurrently, the engine apparatus 100A is illustrated in a state in which the adjustable airflow regulator 510A is in a fully open-state. As discussed above, in this state, the thermal sensing element 530A, which is in the form of a thermal sensor, has sensed that the operating temperature of the engine 100A is at or above an upper-threshold temperature (discussed above). When the engine 100A is sensed to be at or above the upper-threshold temperature, the thermal switch is open, thereby cutting off electrical current generated by the alternator (not shown) from reaching the actuator 520A.

With the actuator 520A not powered, the resilient element 580A biases the rocker arm 542A in counterclockwise direction and forces the actuator into a state in which the cylinder 521A is extended. The rocker arm 542A, in turn, transmits this angular rotational movement to the rotatable radial louvre plate 512A via the connecting rod 543A, thereby rotating (if not already in position) the rotatable radial louvre plate 512A in a clockwise direction about the rotational axis A-A until the first end walls 598A of the circumferential slots 573A of the rotatable radial louvre plate 512A contact the pegs 574A of the fixed radial louvre plate 511A, thereby preventing any further clockwise rotation and maintaining the rotatable radial louvre plate 512A in a fixed angular position relative to the fixed radial louvre plate 511A.

When in this position, the radial slots 518A of the rotatable radial louvre plate 512A are aligned with the radial slots 515A of the fixed radial louvre plate 511A. As such the adjustable airflow regulator 510A is in an open-state because cooling airflow indicated by the (dark arrows in FIG. 7) can flow freely through the collective passageways formed by the radial slots 515A, 518A so as to enter the blower housing 200A via the air inlet 201A and reach the engine 100A to remove heat.

Figure 8:
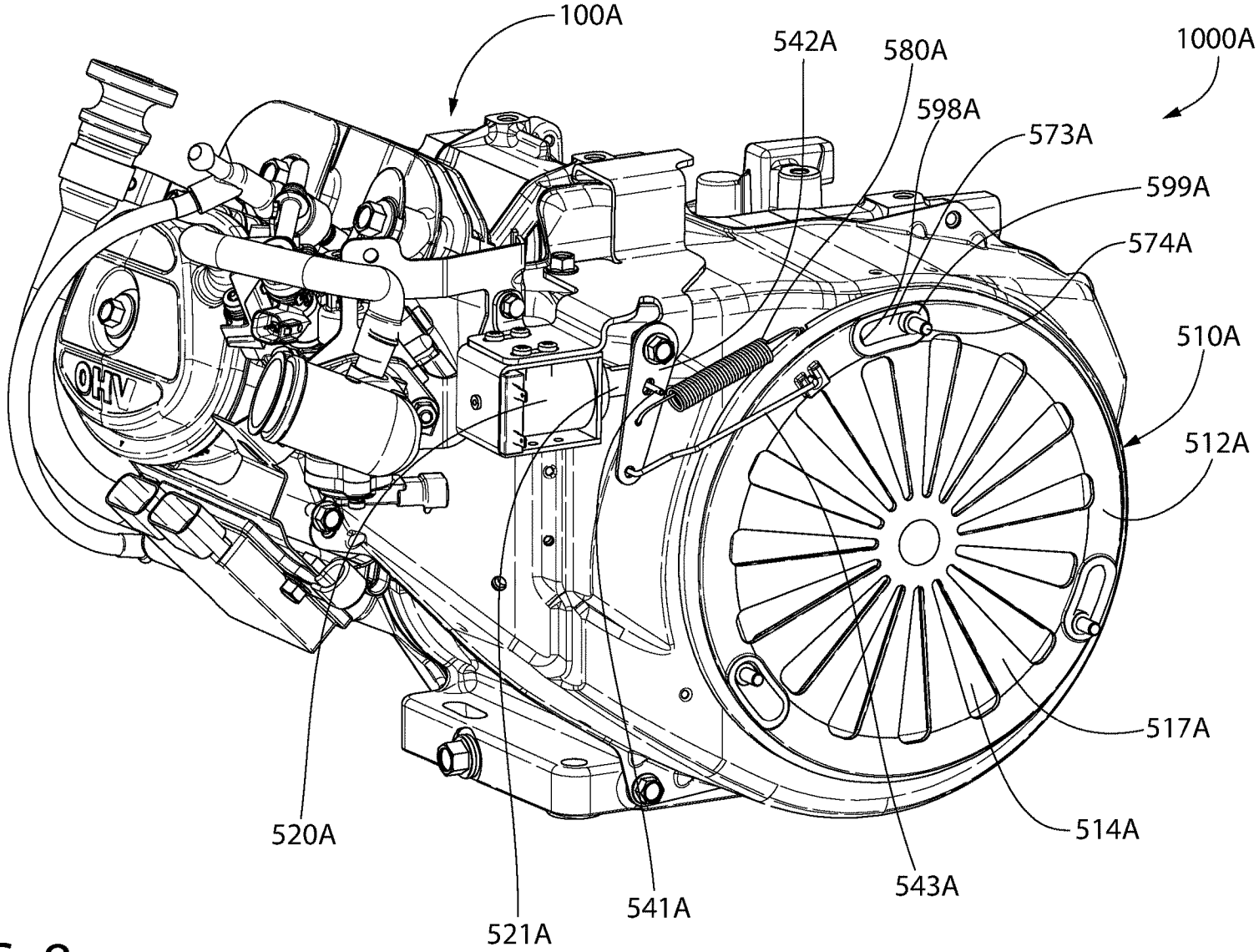
FIG. 8 is a front perspective view of the air-cooled engine apparatus of FIG. 5 wherein the cooling airflow control subsystem is in a closed-state.
Figure 9:
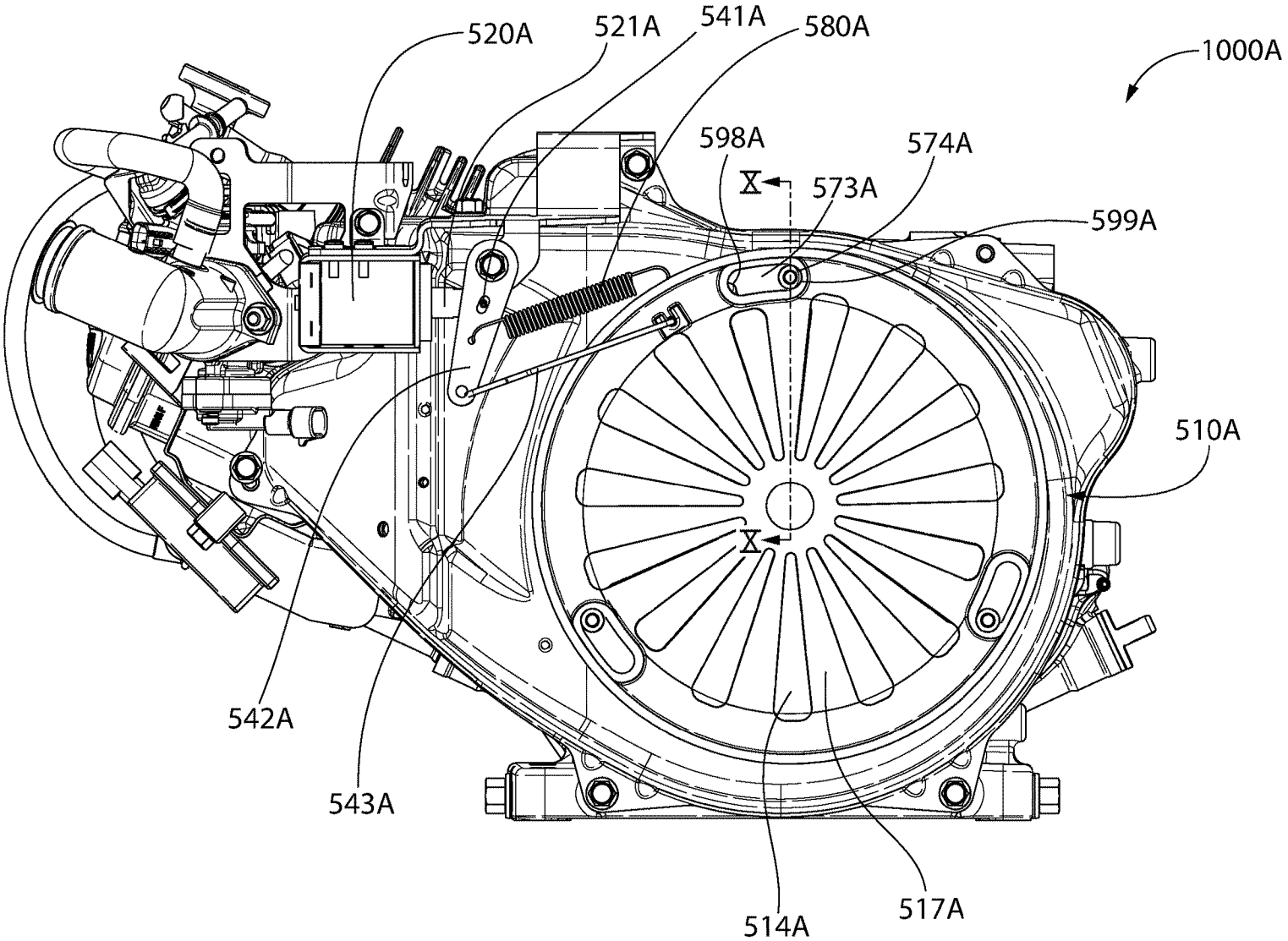
FIG. 9 is a front view of the air-cooled engine apparatus of FIG. 8.
Figure 10:
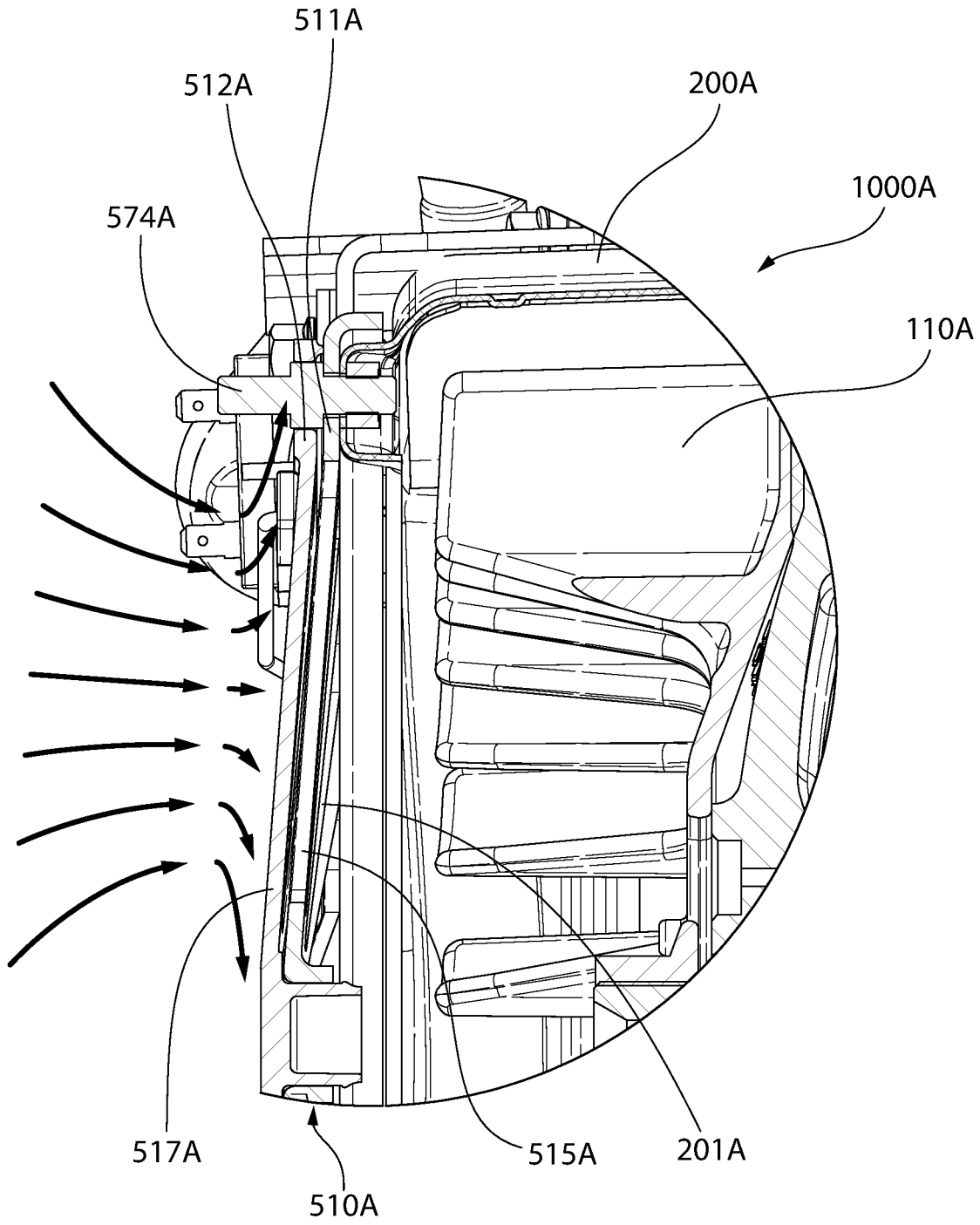
FIG. 10 is a cross-sectional view of the air-cooled engine apparatus taken along view X-X of FIG. 9.

Referring specifically now to FIGS. 8-10 concurrently, the engine apparatus 1000A is illustrated in a state in which the adjustable airflow regulator 510A has been actuated from the open-state of FIGS. 5-7 to a fully closed-state. In this state, the thermal sensing element 530A, which is in the form of the thermal sensor, has sensed that the operating temperature of the engine 100A is at or below a lower-threshold temperature (discussed above). Thus, the thermal switch assumes a closed-state and transmits electrical current generated by the alternator (not shown) to the actuator 520A.

With the actuator 520A powered, the electromagnet solenoid generates a magnetic force on the cylinder 521A that urges the cylinder 521A into a retracted state. As mentioned above, the cylinder 521 is coupled to the rocker arm 542A via the actuator rod 541A. When the actuator is powered, the magnetic force exerted on the cylinder 521A overcomes the biasing force exerted by the resilient element 580A, thereby rotating the rocker arm 542A in the clockwise direction. The rocker arm 542A transmits this angular rotational movement to the rotatable radial louvre plate 512A via the connecting rod 543A, thereby rotating the rotatable radial louvre plate 512A in a counterclockwise direction until the second end walls 599A of the circumferential slots 573A of the rotatable radial louvre plate 512A contact the pegs 574A of the fixed radial louvre plate 511A, thereby preventing any further counterclockwise rotation and maintaining the rotatable radial louvre plate 512A in a fixed angular position relative to the fixed radial louvre plate 511A. During this process, the rotatable radial louvre plate 512A rotates a rotational angle of travel that is established by the length of the circumferential slots 573A.

When in this position, the radial louvers 517A of the rotatable radial louvre plate 512A are aligned with the radial slots 515A of the fixed radial louvre plate 511A. Similarly, the radial slots 518A of the rotatable radial louvre plate 512A are aligned with the radial louvres 514A of the fixed radial louvre plate 511A. As a result, the radial louvers 517A of the rotatable radial louvre plate 512A and the radial louvres 514A of the fixed radial louvre plate 511A collectively form an airflow barrier that prevents cooling air from entering the blower housing 200A via the air inlet 201A (as shown by the dark arrows of FIG. 10). As a result, heat cannot be adequately removed from the engine 100A and the operating temperature of the engine 100A will begin to rise, which results in a rise of oil temperature.

While the fixed and rotatable louver plates 511A, 512A comprises slots 515A, 518A that are elongated and radially extending in orientation, in other arrangements the fixed and rotatable louver plates 511A, 512A are provided with different shaped apertures that are arranged in different patterns. So long as the apertures of the fixed and rotatable louver plates 511A, 512A can be brought in out of alignment by relative movement between the fixed and rotatable louver plates 511A, 512A as discussed above, the cooling airflow can be adjusted in accordance with the present invention. Additionally, while the resilient element 580A is exemplified as a linear spring, many other types of resilient elements can be utilized, including leaf springs, coil springs, rubber members, elastomeric bands, elastomer blocks, or combinations thereof. Moreover, the biasing force on the actuator can be provided through other structures, such as magnets or counter weights.

Figure 11:
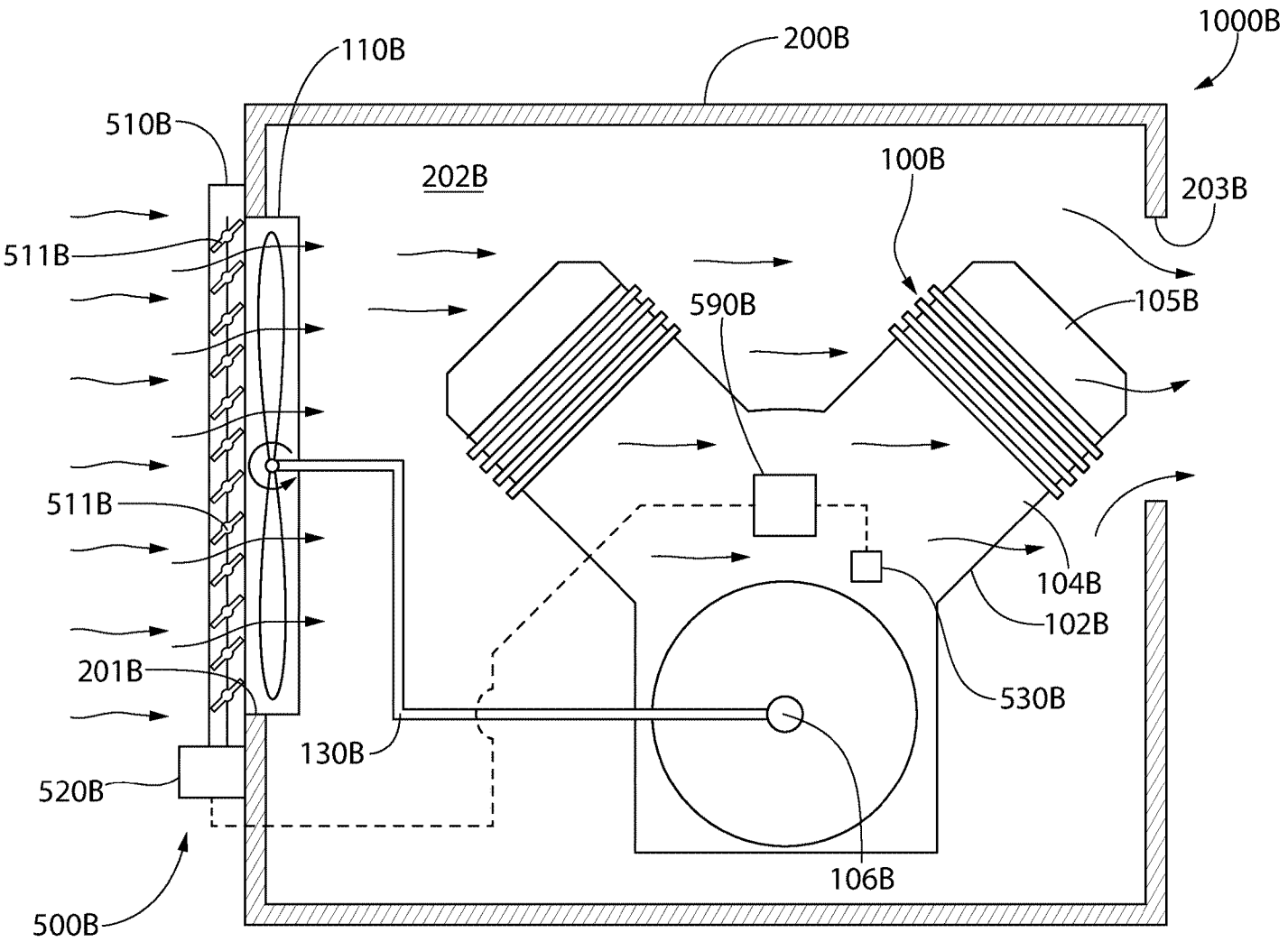
FIG. 11 is a schematic of an engine apparatus having an electronic version of a cooling airflow control subsystem incorporated therein in accordance with the present invention, wherein the electronic cooling airflow control subsystem is in an open-state.
Figure 12:
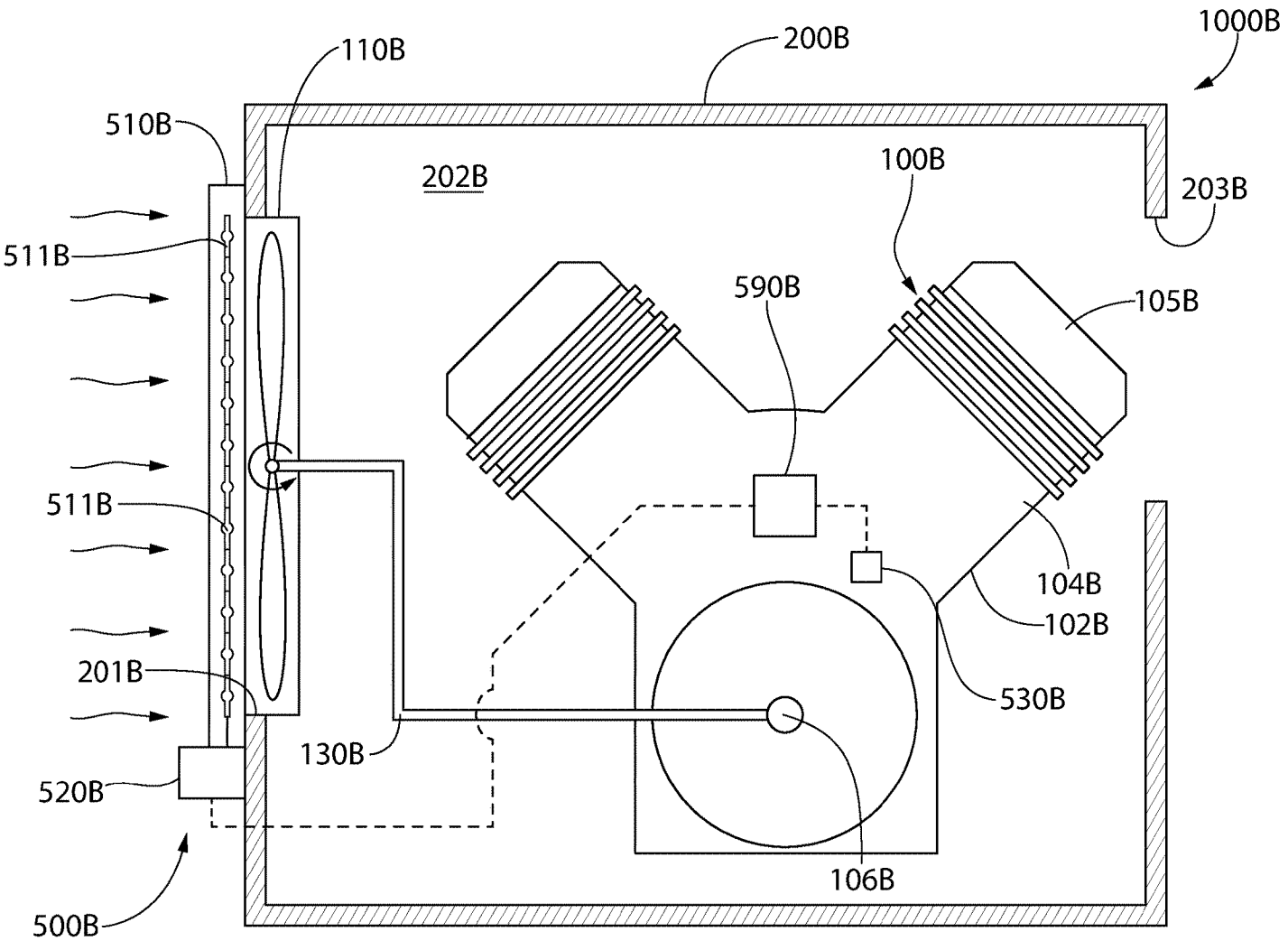
FIG. 12 is a schematic of the engine apparatus of FIG. 11, wherein the electronic version of the cooling airflow control subsystem is in a closed-state.
Figure 13:
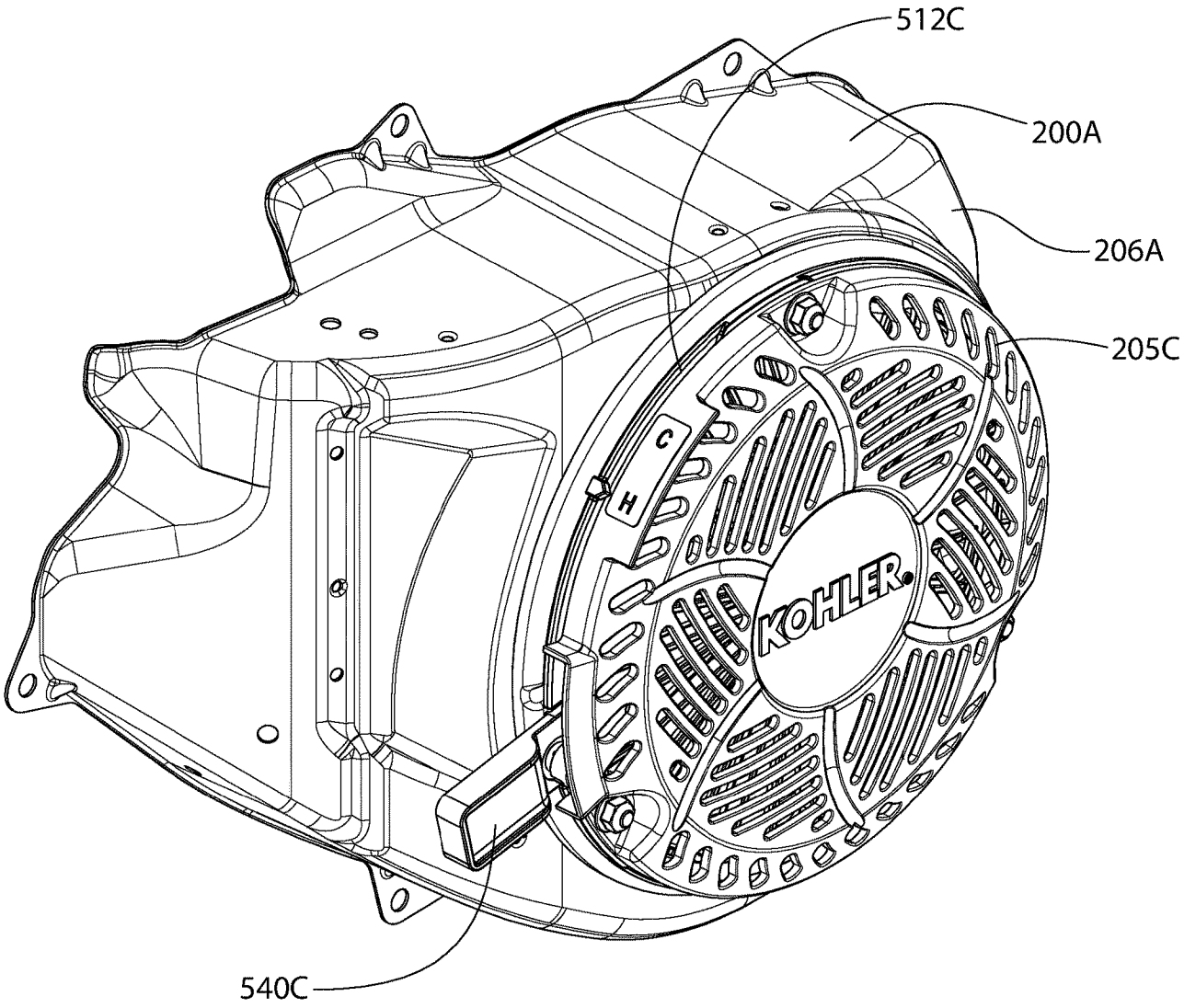
FIG. 13 is a front perspective view a cooling airflow control subsystem in accordance with the present invention.

Referring now to FIGS. 11 and 12 concurrently, an engine apparatus 1000B according to the present invention is schematically illustrated. The engine apparatus 1000B is substantially identical to the engine apparatus 1000 discussed above for FIGS. 1-2. Thus, like components will be referenced to with like numerical identifiers with the exception that the alphabetical suffix "B" will be added. Moreover, only those aspects of the engine apparatus 1000B that differ from the engine apparatus 1000 will be discussed below in order to avoid redundancy and with the understanding that the discussion set forth above for the engine apparatus 1000 is applicable to the engine apparatus 1000B in all other regards.

The difference between the engine apparatus 1000 and the engine apparatus 1000B is that the cooling airflow control system 500B is an electronically-controlled system. Specifically, in this arrangement, the temperature sensing element 530B is a temperature sensor that capable of generating signals indicative of the sensed operating temperature of the engine 100B. These signals are received by a system controller 590B for processing. The controller 590B is operably coupled to the actuator 520B. The controller 590B can operate the actuator 520B in a desired manner by generating and transmitting control signals, the exact nature of which will be determined by the controller 590B based on the received temperature signals from the temperature sensor 530B. For example, if the temperature sensor 530B sends a temperature signal to the controller 590B that the controller 590B determines is at or above an upper-threshold temperature (discussed above), the controller 590B will instruct the actuator 520B to ensure that the adjustable airflow regulator 510B is in the open-state (FIG. 1). Additionally, if the temperature sensor 530B sends a temperature signal to the controller 590B that the controller 590B determines is at or below a lower-threshold temperature (discussed above), the controller 590B will instruct the actuator 520B to ensure that the adjustable airflow regulator 510B is in the closed-state (FIG. 2).

The controller 590B may comprise a processor and a memory device, which may be separate components or an integrated package. Moreover, while only one processor and one memory device may be utilized, the controller 590B may comprise multiple processors and multiplier memory devices. The processor may be any computer central processing unit (CPU), microprocessor, micro-controller, computational device, or circuit configured for executing some or all of the processes described herein, including without limitation: (1) the retrieval and/or computation of upper and lower threshold temperatures from data stored in the memory device; (2) comparison of the determined upper and lower threshold temperatures to the temperature signals generated by the temperature sensor; and (3) the generation and transmission of appropriate control signals to the actuator based on the previous comparison. In one arrangement, the controller 590B and the temperature may be integrated into an ignition module.

In a further arrangement of the electronic cooling airflow control system 500B, the temperature sensing element 530B is replaced with a fuel sensor that is contact with the oil and that detect the presence and/or concentration levels of fuel in the oil. In such an arrangement, the fuel sensor sends signals to the controller 590B for processing. If the fuel sensor sends a signal to the controller 590B that is indicative of fuel being present in the oil in sufficient quantities/concentrations (as determined by the controller 590B), the controller 590B will instruct the actuator 520B to ensure that the adjustable airflow regulator 510B is in the closed-state (FIG. 2). Additionally, if the fuels sensor sends a signal to the controller 590B that is indicative that fuel is not present in the oil in sufficient quantities/concentrations (as determined by the controller 590B), the controller 590B will instruct the actuator 520B to ensure that the adjustable airflow regulator 510B is in the open-state (FIG. 1).

FIGS. 13-18 show examples of alternate embodiments that involve manual switching of the cooling airflow control system. These examples require a user to manually actuate an actuator that rotates the rotatable louver plate between an open position and a less-open position.

Figure 14:
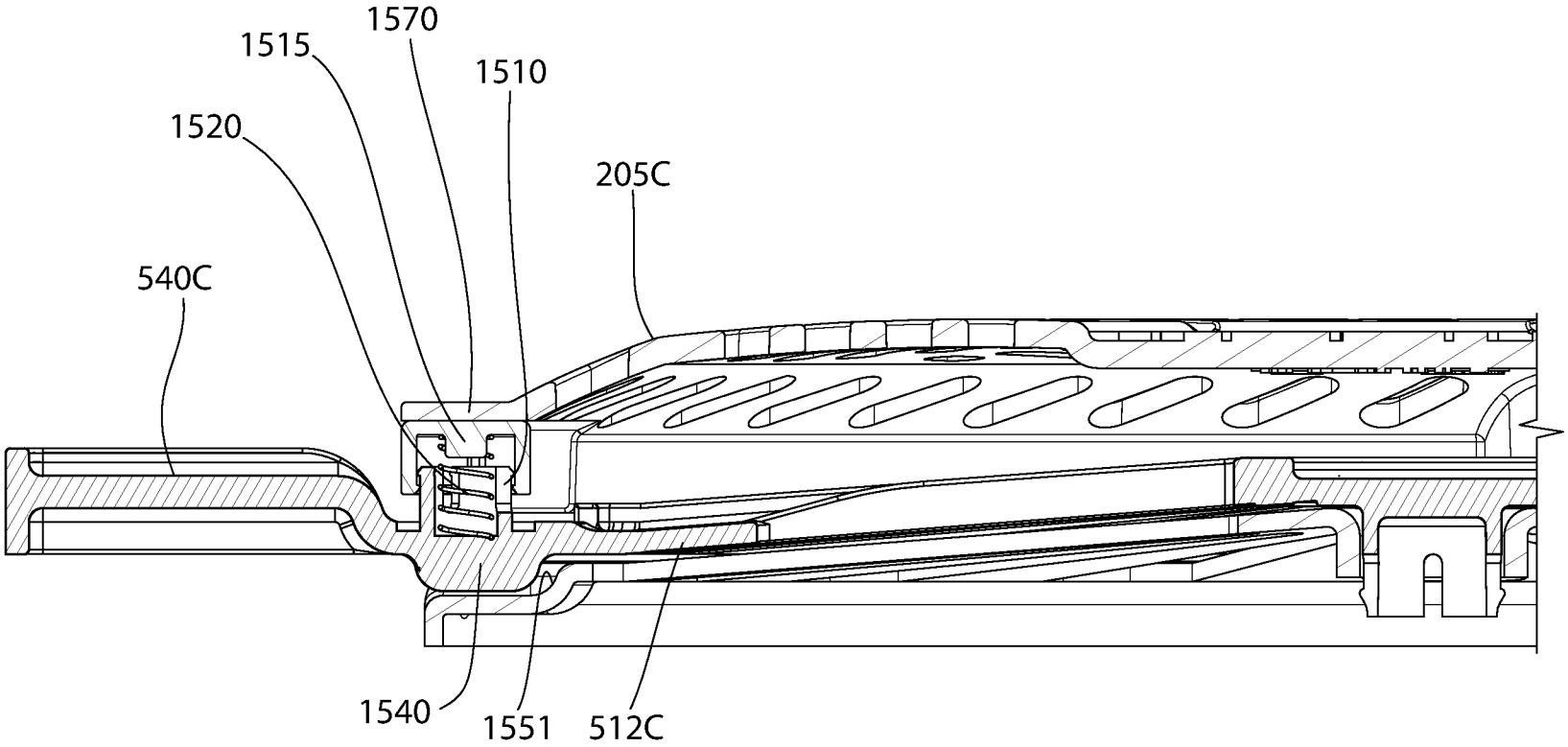
FIG. 14 is a sectional view of the cooling airflow system of FIG. 13.
Figure 15:
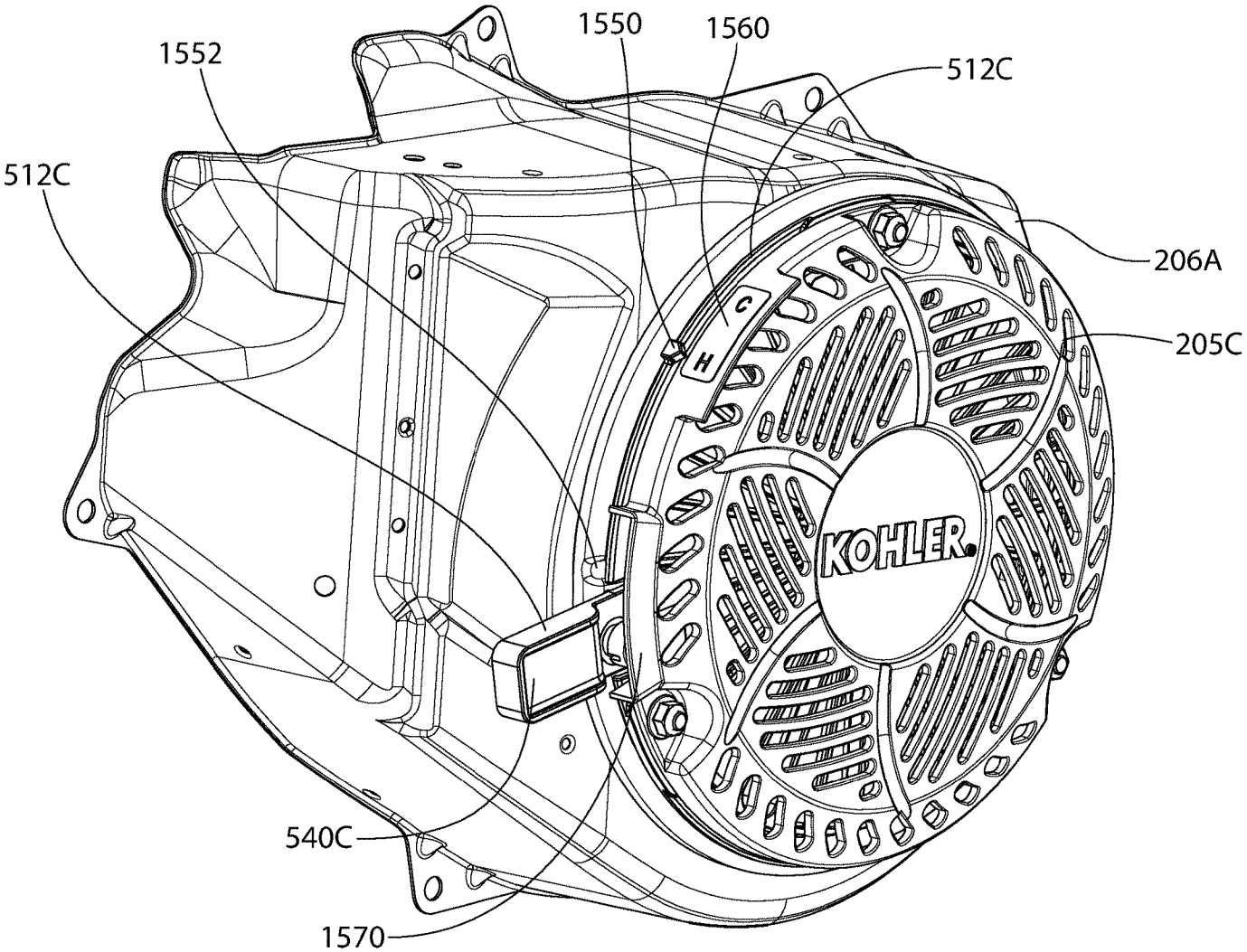
FIG. 15 is a front perspective view of the cooling airflow system of FIG. 13 with the protective blower cover in place.
Figure 16:
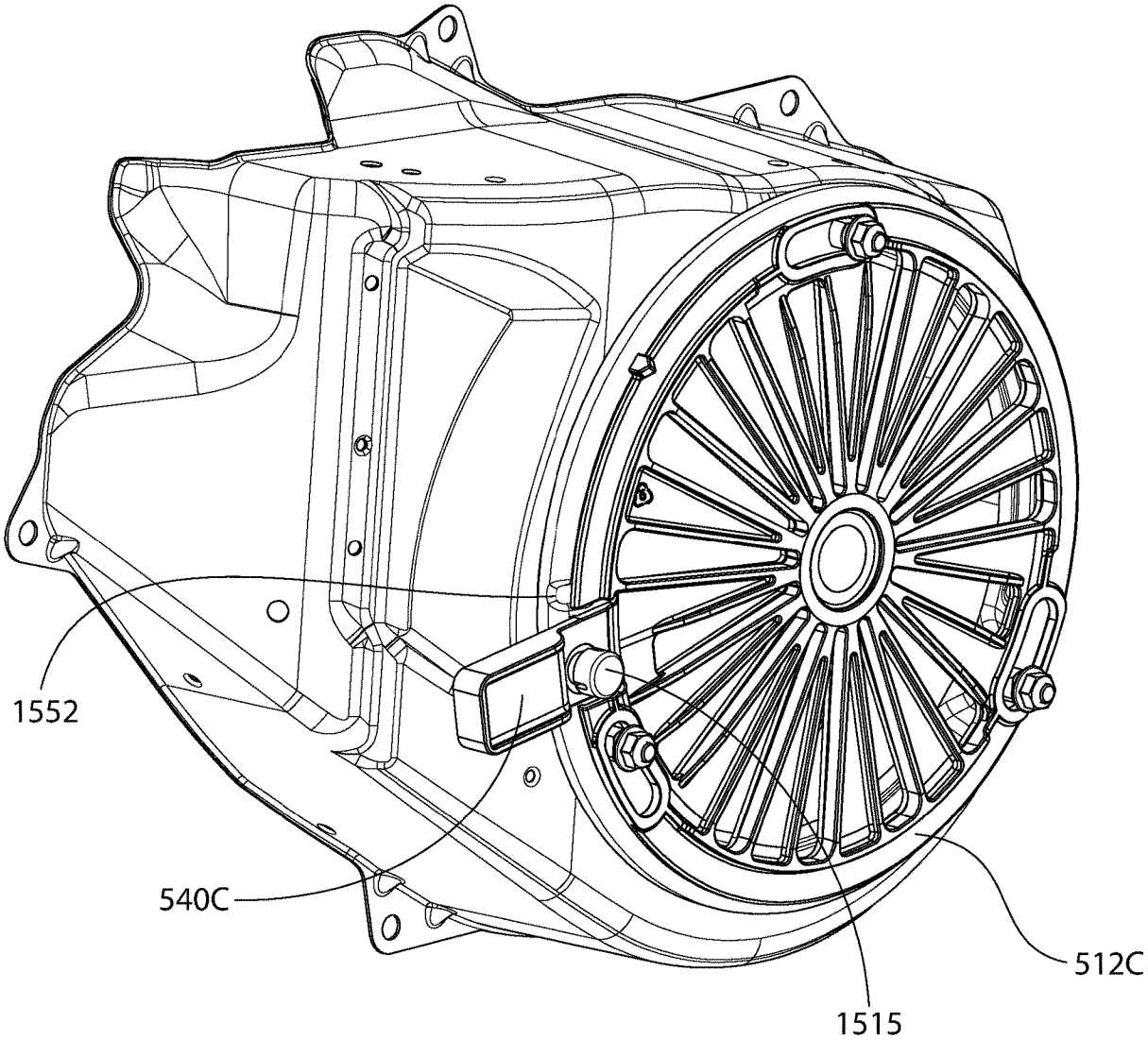
FIG. 16 is a front perspective view of the cooling airflow system of FIG. 13 with the protective blower cover removed.

FIGS. 13-16 show an exemplary embodiment that has a handle 540C that extends from the rotatable louver plate 512C (best shown in FIG. 16). Similarly to other embodiments, a protective blower cover 205C is provided. As shown in FIGS. 14 and 16, a guide cap 1515 is spring mounted to a cup-shaped protrusion 1510 that extends from the rotatable louver plate 512C. The guide cap 1515 is urged (upward in FIG. 14) against a rotation limiter 1570 (FIGS. 14 and 15) and limits the rotation between two predetermined positions. In this example, the two predetermined locations represent a more-closed state of the cooling airflow control system and a less-closed state. In some embodiments, the more-closed state is a state where all air flow slots are blocked. In some embodiments, the less-closed state is a state where all air flow slots are fully open. Some embodiments include a more-closed state and/or a less-closed state that is somewhere between fully blocked and fully open. This example includes a position indicator 1550 that extends from the rotatable louver plate 512C and displays the current position of the rotatable louver plate 512C. The position indicator 1550 points to a position label 1560 to indicate the position of the rotatable louver plate 512C. In this example, the position label includes the markings "H" and "C". Referring to FIG. 15, when the rotatable louver plate 512C is moved to the more-closed position (as shown in FIG. 15), the position indicator 1550 points to "H", indicating the state that will result in the engine running hotter. When the rotatable louver plate 512C is moved to the less-closed position, the position indicator 1550 points to "C", indicating the state that will result in maximum cooling of the engine.

In this example, in addition to the rotation limiter 1570, a pair of indentations 1551, 1552 are provided in the fixed louver plate 511C or some other fixed part of the assembly. In this example, indentation 1551 (FIG. 14) corresponds to the more-closed state ("H") and indentation 1552 (FIGS. 15 and 16) corresponds to the less-closed state ("C"). A locating protrusion 1540 extends (downward in FIG. 14) from the rotatable louver plate 512C and is configured to engage the indentations 1551, 1552. A spring 1520, laterally located by a locator 1515, provides an urging force to press the locating protrusion 1540 (downward in FIG. 14) away from the rotation limiter 1570 and into the indentations 1551, 1552 to help keep the rotatable louver plate 512C in the selected position. While only two indentations 1551, 1552 are shown in this example, it is noted that more than two indentations can be provided to enable the rotatable louver plate 512C to be held in one or more intermediate positions. Such intermediate positions can provide cooling flow between the more-closed state and the less-closed state.

In some embodiments, the less-closed ("C") position is the position in which the handle 540C is in the vertically lower position. In some embodiments, if there is a part failure, vibration from the engine might move the handle 540C to its lowest vertical position due to gravity. By configuring the device to have the most cooling when the handle 540C is in the lowest position, the default position is one in which more engine cooling is provided.

Figure 17:
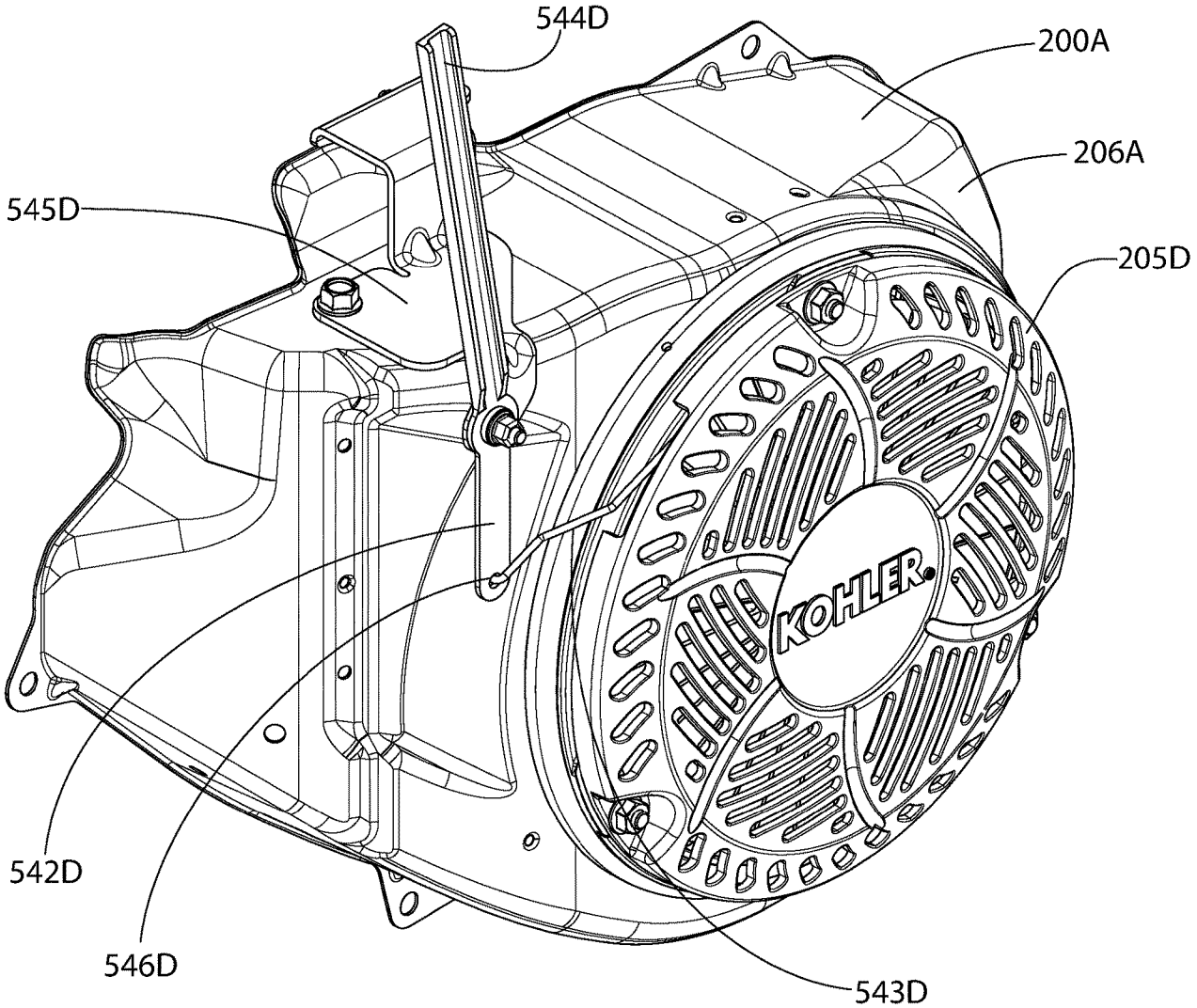
FIG. 17 is a front perspective view a cooling airflow control subsystem in accordance with the present invention.

FIG. 17 shows another example of a manually operated cooling airflow control system. In this example, a lever 544D extends away from protective blower cover 205D to provide a user-engageable member for manually moving the rotatable louver plate. In this example, the lever 544d has, or is attached to, a lower lever member 542D and pivots around a pivot point such as, for example, a bolt or pin. The pivot point can be attached to a plate 545D or other fixed point on the system. In this example, the lower lever member 542D has a hole 546D that receives a connecting wire 543D that links the lever 544D to the rotatable louver plate. When a user moves the lever 544D, motion is transmitted to the rotatable louver plate through the lower lever member 542D and the connecting wire 543D such that the rotatable louver plate is rotated between a more-closed position and a less-closed position.

Figure 18:
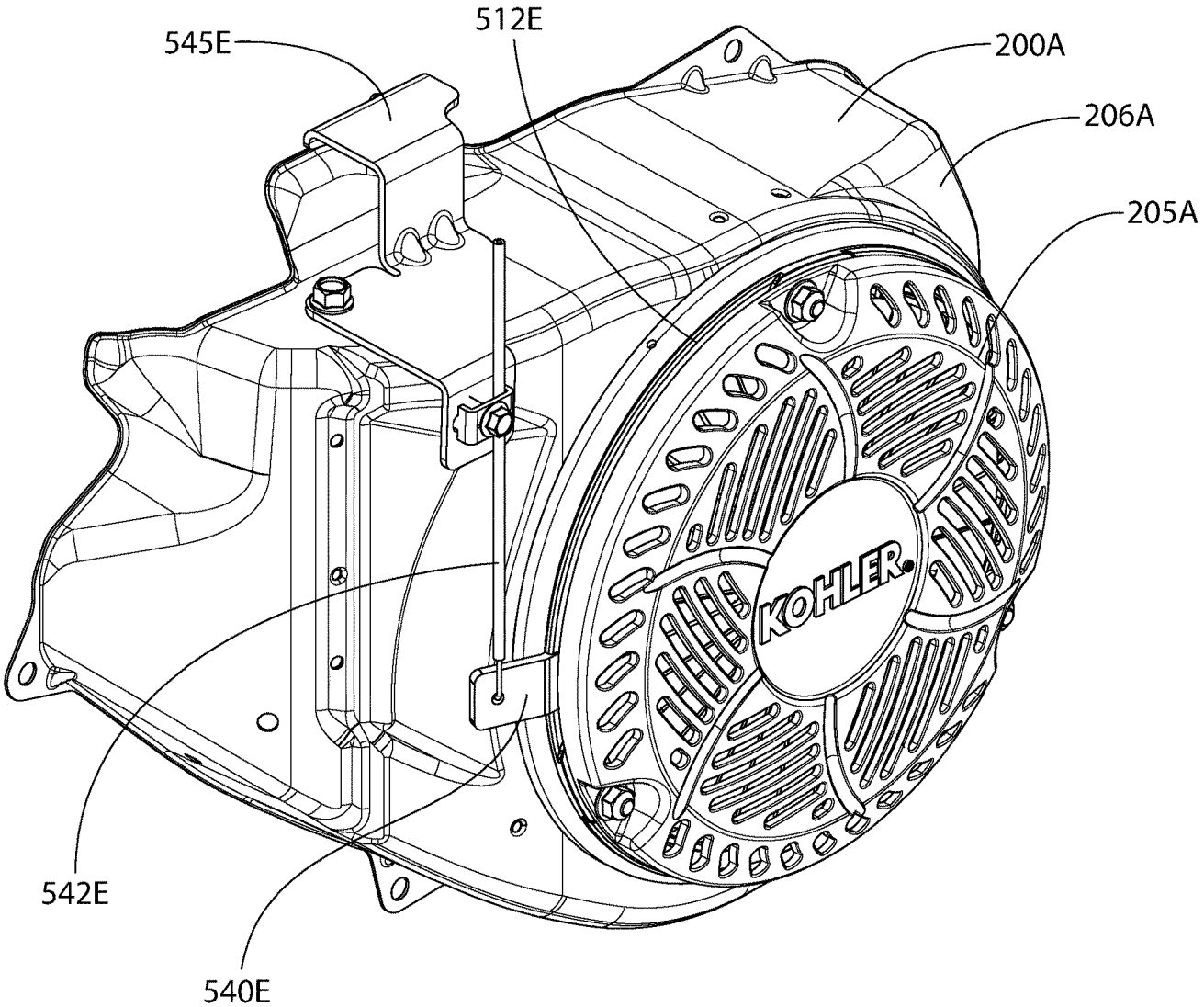
FIG. 18 is a front perspective view a cooling airflow control subsystem in accordance with the present invention.

FIG. 18 shows another example of a manually operated cooling airflow control system. In this example, a tab 540E extends radially from, and is positionally fixed to, the rotatable louver plate 512E. When the tab 540E is moved, the rotatable louver plate 512E is rotated. A sheathed cable 542E is attached to the tab 540E and extends away from the rotatable louver plate 512E. The sheath of the cable 542E can be attached to a plate 545E or other fixed point on the system. When a user pulls or pushes the cable 542E, motion is transmitted to the rotatable louver plate 512E through the tab 540E such that the rotatable louver plate is rotated between a more-closed position and a less-closed position. The cable can extend to any position that is convenient for the user. For example, the cable can extend to a knob located on a dash board of a cart or the handle bars of a tool.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An engine apparatus comprising:

an air cooled internal combustion engine;

a cooling airflow control subsystem comprising:

an airflow regulator comprising:

a first component comprising one or more passageways extending through the first component; and a second component comprising one or more passageways extending through the second component, the second component mounted adjacent the first component;

an actuator operably coupled to the airflow regulator to cause relative motion between the first and second components when actuated so that the airflow regulator can be altered between: (1) a first state in which the first and second passageways are aligned a first extent to allow a first amount of cooling airflow to reach the engine; and (2) a second state in which the first and second passageways are aligned a second extent to allow a second amount of cooling airflow to reach the engine, the first amount being greater than the second amount;

a thermal switch operably coupled to an engine block or head of the engine, the thermal switch being selectively changeable between: (i) a closed position in which an electric current is allowed to flow to the actuator, causing the actuator to change the airflow regulator to the second state; and (ii) an open position in which the electric current is prevented from flowing to the actuator, causing the actuator to maintain the first state.

2. The engine apparatus according to claim 1 further comprising:

the first component comprising a plurality of first louvers, the one or more first passageways defined between the plurality of first louvers; and the second component comprising a plurality of second louvers, the one or more second passageways defined between the plurality of second louvers.

3. The engine apparatus according to claim 2 further comprising:

the relative rotation between the first and second components taking place about a rotational axis;

the plurality of first louvers extending radially outward from the rotational axis; and the plurality of second louvers extending radially outward from the rotational axis.

4. The engine apparatus according to claim 2 further comprising:

the first component being a first plate comprising the plurality of first louvers, the plurality of first louvers lying in a first plane;

the second component being a second plate comprising the plurality of second louvers, the plurality of second louvers lying in a second plane; and wherein the plurality of first louvers remain in the first plane and the plurality of second louvers remain in the second plane in both the first and second states.

5. The engine apparatus according to claim 1 further comprising:

the internal combustion engine having one or more cooling fins;

a blower housing mounted to the engine and comprising an air inlet opening;

an airflow generator mounted within the blower housing and aligned with the air inlet opening; and the airflow regulator covering the air inlet opening of the blower housing.

6. The engine apparatus according to claim 1 wherein the relative rotation between the first and second components takes place about a rotational axis that extends substantially parallel to a primary direction of the first amount of cooling airflow in the first-state.

7. The engine apparatus according to claim 1 wherein the airflow regulator comprises an angular rotation limiter that limits the relative rotation between the first component and the second component to a predetermined angle of rotation.

8. The engine apparatus according to claim 1 wherein the airflow regulator is biased into the first state.

9. The engine apparatus according to claim 1 further comprising:

the actuator comprising a manually-operated lever; and wherein the airflow regulator comprises a locking assembly that locks the first and second components in a selected one of the first and second states.

10. The engine apparatus according to claim 1 wherein the thermal switch is configured to detect a temperature of the engine.

11. The engine apparatus according to claim 1 wherein the thermal switch is configured to switch from the closed position to the open position at a predetermined temperature.

12. The engine apparatus according to claim 11 wherein the engine comprises oil, the predetermined temperature selected to achieve complete vaporization of fuel within the oil.

13. An engine apparatus comprising:

an air cooled internal combustion engine comprising an engine block and a head;

a cooling airflow control subsystem comprising:

an airflow regulator;

an actuator operably coupled to the airflow regulator so that the airflow regulator can be altered between: (1) a first-state in which a first amount of cooling airflow is allowed to reach the internal combustion engine; and (2) a second-state in which a second amount of cooling airflow is allowed to reach the internal combustion engine, the first amount being greater than the second amount, the first amount being greater than the second amount and the airflow regulator configured to be biased into the first state; and a thermal switch operably coupled to the engine block or the head of the engine, the thermal switch being selectively changeable between: (i) a closed position in which an electric current is allowed to flow to the actuator, causing the actuator to change the airflow regulator to the second state; and (ii) an open position in which the electric current is prevented from flowing to the actuator, causing the actuator to maintain the first state.

14. The engine apparatus according to claim 13 wherein the thermal switch is configured to detect a temperature of the engine.

15. The engine apparatus according to claim 13 wherein the thermal switch is configured to switch from the closed position to the open position at a predetermined temperature.

16. The engine apparatus according to claim 15 wherein the engine comprises oil, the predetermined temperature selected to achieve complete vaporization of fuel within the oil.

17. The engine apparatus according to claim 13 wherein the actuator comprises a manually-operated lever that is operated by a user to alter the airflow regulator between the first and second states.

18. An engine apparatus comprising:

an internal combustion engine;

a cooling airflow control subsystem comprising, in operable cooperation:

a sensing element configured to detect a temperature of oil in the engine; and an airflow regulator operably coupled to the sensing element, the airflow regulator alterable between: (1) a first-state in which a first amount of cooling airflow is allowed to reach the engine; and (2) a second-state in which a second amount of cooling airflow is allowed to reach the engine, the first amount being greater than the second amount;

wherein upon the sensing element detecting the temperature of the engine is below a predetermined threshold, the airflow regulator being altered from the first-state to the second-state, the predetermined threshold being selected to completely vaporize fuel in the oil.

19. The engine apparatus according to claim 18 wherein the cooling airflow control subsystem is configured to return from the second-state to the first-state after the temperature exceeds the predetermined threshold.

20. The engine apparatus according to claim 18 wherein the engine comprises an oil sump, the sensing element configured to sense the temperature of the oil in the oil sump.

* * * * *